US008967796B2

(12) United States Patent
Ito et al.

(10) Patent No.: US 8,967,796 B2
(45) Date of Patent: Mar. 3, 2015

(54) INKJET RECORDING APPARATUS

(71) Applicants: Tsuyoshi Ito, Nagoya (JP); Wataru Sugiyama, Nishio (JP); Yuji Koga, Nagoya (JP); Takashi Omura, Nagoya (JP); Kenji Samoto, Nagoya (JP)

(72) Inventors: Tsuyoshi Ito, Nagoya (JP); Wataru Sugiyama, Nishio (JP); Yuji Koga, Nagoya (JP); Takashi Omura, Nagoya (JP); Kenji Samoto, Nagoya (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 0 days.

(21) Appl. No.: 14/169,862

(22) Filed: Jan. 31, 2014

(65) Prior Publication Data

US 2014/0146118 A1 May 29, 2014

Related U.S. Application Data

(63) Continuation-in-part of application No. 13/628,668, filed on Sep. 27, 2012, now Pat. No. 8,696,109.

(30) Foreign Application Priority Data

| | | |
|---|---|---|
| Nov. 28, 2011 | (JP) | 2011-259493 |
| Apr. 27, 2012 | (JP) | 2012-104095 |
| Jan. 31, 2013 | (JP) | 2013-016491 |
| Mar. 22, 2013 | (JP) | 2013-059483 |

(51) Int. Cl.

| | |
|---|---|
| ***B41J 13/00*** | (2006.01) |
| ***B41J 11/00*** | (2006.01) |
| ***B41J 11/06*** | (2006.01) |
| ***B41J 13/10*** | (2006.01) |

(52) U.S. Cl.
CPC ..... *B41J 11/06* (2013.01); *B41J 11/006* (2013.01); *B41J 11/0025* (2013.01); *B41J 13/103* (2013.01)
USPC ..... 347/104

(58) Field of Classification Search
USPC ..... 347/101, 104
See application file for complete search history.

(56) References Cited

U.S. PATENT DOCUMENTS

| | | | | |
|---|---|---|---|---|
| 5,805,176 | A * | 9/1998 | Saito et al. | 347/8 |
| 5,874,979 | A * | 2/1999 | Ohyama | 347/104 |

(Continued)

FOREIGN PATENT DOCUMENTS

| | | | |
|---|---|---|---|
| CN | 101254713 | A | 9/2008 |
| CN | 101804921 | A | 8/2010 |

(Continued)

OTHER PUBLICATIONS

First Office Action and Search Report issued in corresponding Chinese Patent Application No. 20121049718 mailed Jul. 3, 2014.

(Continued)

*Primary Examiner* — Huan Tran
(74) *Attorney, Agent, or Firm* — Banner & Witcoff, Ltd.

(57) ABSTRACT

An inkjet recording apparatus may include a corrugate mechanism configured to form a sheet into a corrugated shape. The inkjet recording apparatus may be configured to receive sheets of various sizes and shapes. Accordingly, in some examples, the inkjet recording apparatus may include differently configured portions to handle sheets of different sizes or shapes. According to one arrangement, the inkjet recording apparatus may be configured to receive passage of sheets of a first size through multiple ones of the differently configured portions while receiving passage of sheets of a second size though limited ones of the differently configured portions.

15 Claims, 14 Drawing Sheets

(56) References Cited

U.S. PATENT DOCUMENTS

| | | | | |
|---|---|---|---|---|
| 6,503,011 | B2 * | 1/2003 | Kono | 400/646 |
| 6,616,361 | B2 * | 9/2003 | Sugiyama | 400/642 |
| 6,659,603 | B2 * | 12/2003 | Kida et al. | 347/104 |
| 6,712,463 | B2 | 3/2004 | Matsumoto | |
| 6,896,432 | B2 * | 5/2005 | Ohyama | 400/642 |
| 7,232,269 | B2 | 6/2007 | Ohyama | |
| 8,696,109 | B2 * | 4/2014 | Ito et al. | 347/104 |
| 2003/0025777 | A1 * | 2/2003 | Sugiyama | 347/104 |
| 2003/0048345 | A1 | 3/2003 | Matsumoto | |
| 2004/0126164 | A1 | 7/2004 | Ohyama | |
| 2005/0168557 | A1 | 8/2005 | Ohyama | |
| 2007/0070113 | A1 | 3/2007 | Kawabata et al. | |
| 2008/0205954 | A1 | 8/2008 | Sugiyama et al. | |
| 2010/0207321 | A1 | 8/2010 | Samoto et al. | |
| 2013/0135409 | A1 | 5/2013 | Ito et al. | |

FOREIGN PATENT DOCUMENTS

| | | | | | |
|---|---|---|---|---|---|
| CN | 203063275 | U | | 7/2013 | |
| JP | 07-68871 | | * | 3/1995 | B41J 13/02 |
| JP | 7285251 | A | | 10/1995 | |
| JP | 10-71711 | | * | 3/1998 | B41J 13/00 |
| JP | 10-071711 | A | | 3/1998 | |
| JP | 2000-071532 | A | | 3/2000 | |
| JP | 2004-106978 | A | | 4/2004 | |
| JP | 2011-063035 | A | | 3/2011 | |

OTHER PUBLICATIONS

Dec. 12, 2014—(US) Non-Final Office Action—U.S. Appl. No. 14/225,604.

* cited by examiner

INKJET RECORDING APPARATUS

CROSS REFERENCE TO RELATED APPLICATIONS

This application is a continuation-in-part of co-pending U.S. patent application Ser. No. 13/628,668 filed on Sep. 27, 2012, which claims priority from Japanese Patent Application No. 2011-259493 filed on Nov. 28, 2011 and Japanese Patent Application No. 2012-104095 filed on Apr. 27, 2012, the entire disclosures of the prior U.S. and Japanese patent applications being incorporated herein by reference. This application also claims priority from Japanese Patent Application No. 2013-016491 filed on Jan. 31, 2013 and Japanese Patent Application No. 2013-059483 filed on Mar. 22, 2013, the entire disclosures of which are incorporated herein by reference.

TECHNICAL FIELD

Aspects described herein relate to an inkjet recording apparatus that records an image onto a sheet while conveying the sheet maintained in a specified shape.

BACKGROUND

A known inkjet recording apparatus is configured to convey a sheet by a conveyor roller pair while holding the sheet by a platen, record an image onto the sheet held by the platen by ejecting ink droplets from a recording head, and discharge the sheet having the recorded image by a discharge roller pair. The known inkjet recording apparatus further comprises a corrugate mechanism configured to form the sheet into a corrugated shape having alternating ridge portions and groove portions so as to prevent the sheet on the platen from curling during the image recording.

SUMMARY

In the known inkjet recording apparatus, because the conveyor roller pair and the discharge roller pair are partially used to convey a smaller size sheet, a sheet conveying force of the conveyor roller pair and/or the discharge roller pair when conveying a smaller size sheet may decrease as compared with when conveying a larger size sheet. Consequently, load applied to the smaller size sheet by the corrugate mechanism may increase relatively. This may adversely affect the conveying accuracy of the smaller size sheet.

According to one or more aspects, an inkjet recording apparatus may be configured to convey a sheet formed into a corrugated shape while ensuring the sheet conveying accuracy.

In one or more example, an inkjet recording apparatus may comprise a first conveyor configured to selectively nip and convey a first sheet and a second sheet in a conveying direction, the second sheet having a shorter length in a first direction than the first sheet, the first direction being perpendicular to the conveying direction and a vertical direction; a recording head comprising nozzles configured to eject ink droplets onto a sheet conveyed by the first conveyor; a corrugate mechanism disposed upstream of the nozzles in the conveying direction and configured to form the sheet into a corrugated shape having alternating ridge portions and groove portions arranged in the first direction; a plurality of second conveyors disposed downstream of the nozzles in the conveying direction and spaced from each other in the first direction, each of the plurality of second conveyors being spaced, in the conveying direction, from a corresponding first portion of the corrugate mechanism, the corresponding first portion configured to form one of the ridge portions in the sheet, the plurality of second conveyors being configured to nip the sheet at nip points and convey the sheet; and a plurality of first pressing portions disposed downstream of the nozzles in the conveying direction and spaced from each other in the first direction, each of the plurality of first pressing portions being spaced, in the conveying direction, from a corresponding second portion of the corrugate mechanism, the corresponding second portion configured to form one of the groove portions in the sheet, the plurality of first pressing portions being configured to contact, at lower ends thererof, an upper surface of the sheet, and the lower ends being positioned lower than the nip points of the plurality of second conveyors. The inkjet recording apparatus defines a first zone configured to receive passage of the first sheet but not passage of the second sheet, and a second zone configured to receive passage of the first sheet and the second sheet. The plurality of first pressing portions comprise first pressing portions positioned in the first zone and first pressing portions positioned in the second zone, and a pressing force per unit area configured to be applied to the sheet by the first pressing portions positioned in the second zone is less than a pressing force per unit area configured to be applied to the sheet by the first pressing portions positioned in the first zone.

In some example, an inkjet recording apparatus may comprise a first conveyor configured to selectively nip and convey a first sheet and a second sheet in a conveying direction, the second sheet having a shorter length in a first direction than the first sheet, the first direction being perpendicular to the conveying direction and a vertical direction; a recording head comprising nozzles configured to eject ink droplets onto a sheet conveyed by the first conveyor; a corrugate mechanism disposed upstream of the nozzles in the conveying direction and configured to form the sheet into a corrugated shape having alternating ridge portions and groove portions arranged in the first direction; a plurality of second conveyors disposed downstream of the nozzles in the conveying direction and spaced from each other in the first direction, each of the plurality of second conveyors being spaced, in the conveying direction, from a corresponding first portion of the corrugate mechanism, the corresponding first portion configured to form one of the ridge portions in the sheet, the plurality of second conveyors being configured to nip the sheet at nip points and convey the sheet; and a plurality of first pressing portions disposed downstream of the nozzles in the conveying direction and spaced from each other in the first direction, each of the plurality of first pressing portions being spaced, in the conveying direction, from a corresponding second portion of the corrugate mechanism, the corresponding second portion configured to form one of the groove portions in the sheet respectively, the plurality of first pressing portions being configured to contact, at lower ends thererof, an upper surface of the sheet, and the lower ends being positioned lower than the nip points of the plurality of second conveyors. The inkjet recording apparatus defines, in the first direction, a first zone configured to receive passage of the first sheet but not passage of the second sheet, and a second zone configured to receive passage of the first sheet and the second sheet. The first pressing portions comprise upstream pressing portions positioned in the first zone and the second zone and arranged in the first direction, and downstream pressing portions positioned in the first zone but not in the second zone and arranged in the first direction at positions downstream of the upstream pressing portions in the conveying direction.

In some example, an inkjet recording apparatus may comprise a first conveyor configured to selectively nip and convey a first sheet and a second sheet in a conveying direction, the second sheet having a shorter length in a first direction than the first sheet, the first direction being perpendicular to the conveying direction and a vertical direction; a recording head comprising nozzles configured to eject ink droplets onto a sheet conveyed by the first conveyor; a platen configured to move up and down between a first position and a second position and comprising a plurality of ribs disposed downstream of the first conveyor in the conveying direction and extending in the conveying direction, the plurality of ribs being spaced from each other in the first direction and configured to support, at upper edges thereof, the sheet conveyed by the first conveyor; a plurality of pressing portions spaced from each other in the first direction and each interposed between a corresponding pair of the plurality of ribs, the plurality of pressing portions being configured to contact, at lower ends thereof, the upper surface of the sheet held by the plurality of ribs; a support member configured to support the platen when the platen moves down into the second position; and a plurality of urging members, each of the urging members being sandwiched between the platen and the support member and configured to urge the platen upward toward the first position. The inkjet recording apparatus define a first zone configured to receive passage of the first sheet but not passage of the second sheet, and a second zone configured to receive passage of the first sheet and the second sheet. The platen further comprises a plurality of protrusions protruding toward the support member, and a portion of the platen positioned in the second zone is deformable toward the support member when the support member receives the plurality of protrusions of the platen in the second position.

DESCRIPTION OF THE DRAWINGS

For a more complete understanding of the present disclosure, needs satisfied thereby, and the objects, features, and advantages thereof, reference now is made to the following descriptions taken in connection with the accompanying drawings.

DETAILED DESCRIPTION OF EMBODIMENTS

Figure 1:
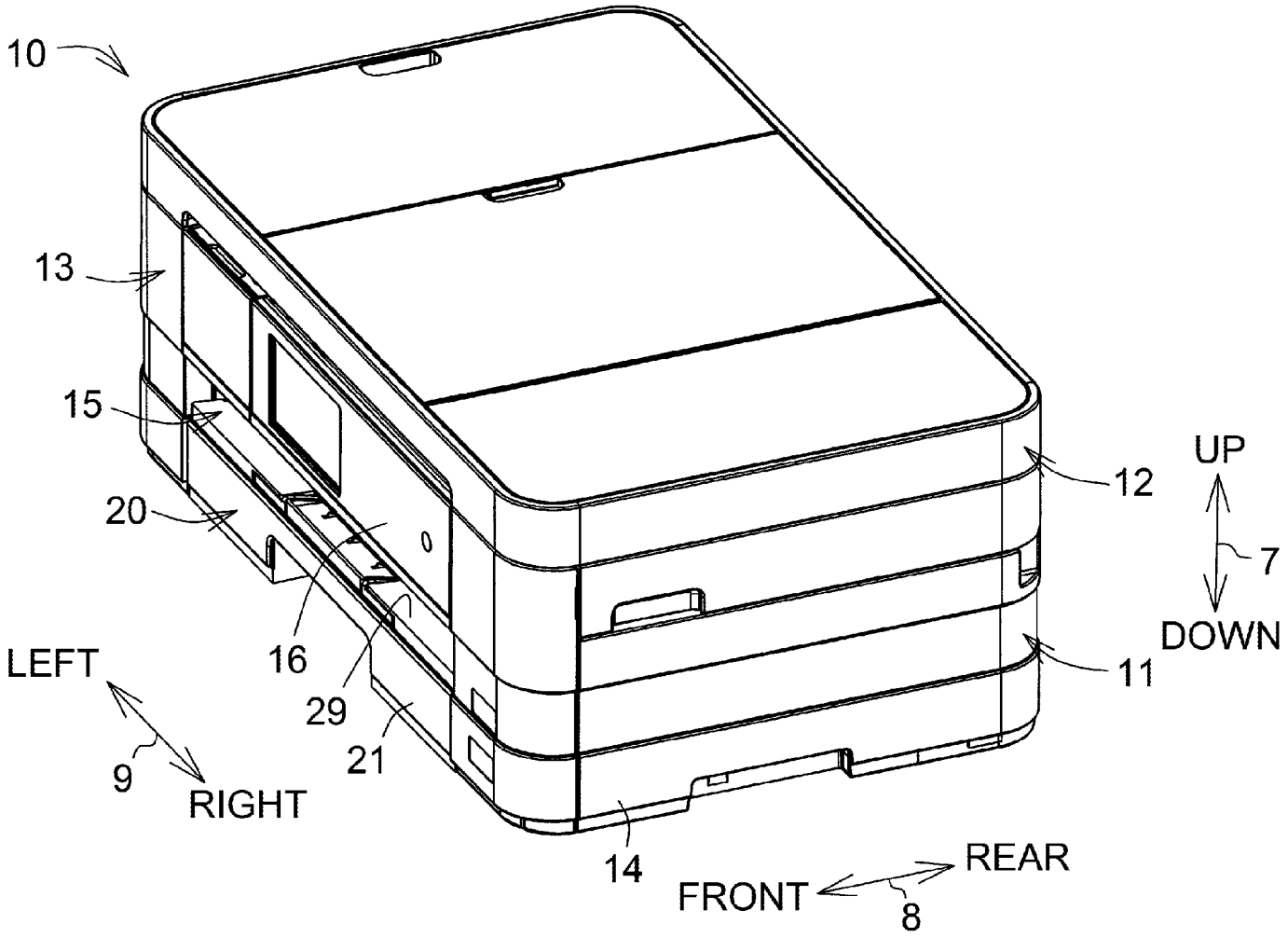
FIG. 1 is a perspective view depicting an inkjet recording apparatus in a first illustrative embodiment according to one or more aspects of the disclosure.

Illustrative embodiments according to one or more aspects are described below with reference to the accompanying drawings. The illustrative embodiments described below are only examples. Various changes, arrangements and modifications may be applied therein without departing from the spirit and scope of the disclosure. As depicted in FIG. 1, an up-down direction 7 may be defined with reference to an inkjet recording apparatus 10 disposed in an orientation in which it is intended to be used. A side of the inkjet recording apparatus 10, in which a control panel 16 may be provided, may be defined as the front of the inkjet recording apparatus 10. A front-rear direction 8 may be defined with reference to the front of the inkjet recording apparatus 10. A right-left direction 9 may be defined with respect to the inkjet recording apparatus 10 as viewed from its front. Hereinafter, a first illustrative embodiment according to the one or more aspects of the disclosure is described.

As depicted in FIG. 1, the inkjet recording apparatus 10 may comprise a printer unit 11 and a scanner unit 12. The printer unit 11 may be configured to record an image onto a sheet 6 (see FIG. 2). The sheet 6 may be, for example, recording paper, glossy paper, a postcard and/or other types of printing/recording media. The scanner unit 12 may be configured to read an image recorded on a document (not depicted). The inkjet recording apparatus 10 may be configured to perform one or more of printing, scanning, and copying. The inkjet recording apparatus 10 may not necessarily comprise the scanner unit 12, whose detailed description is omitted.

Figure 2:
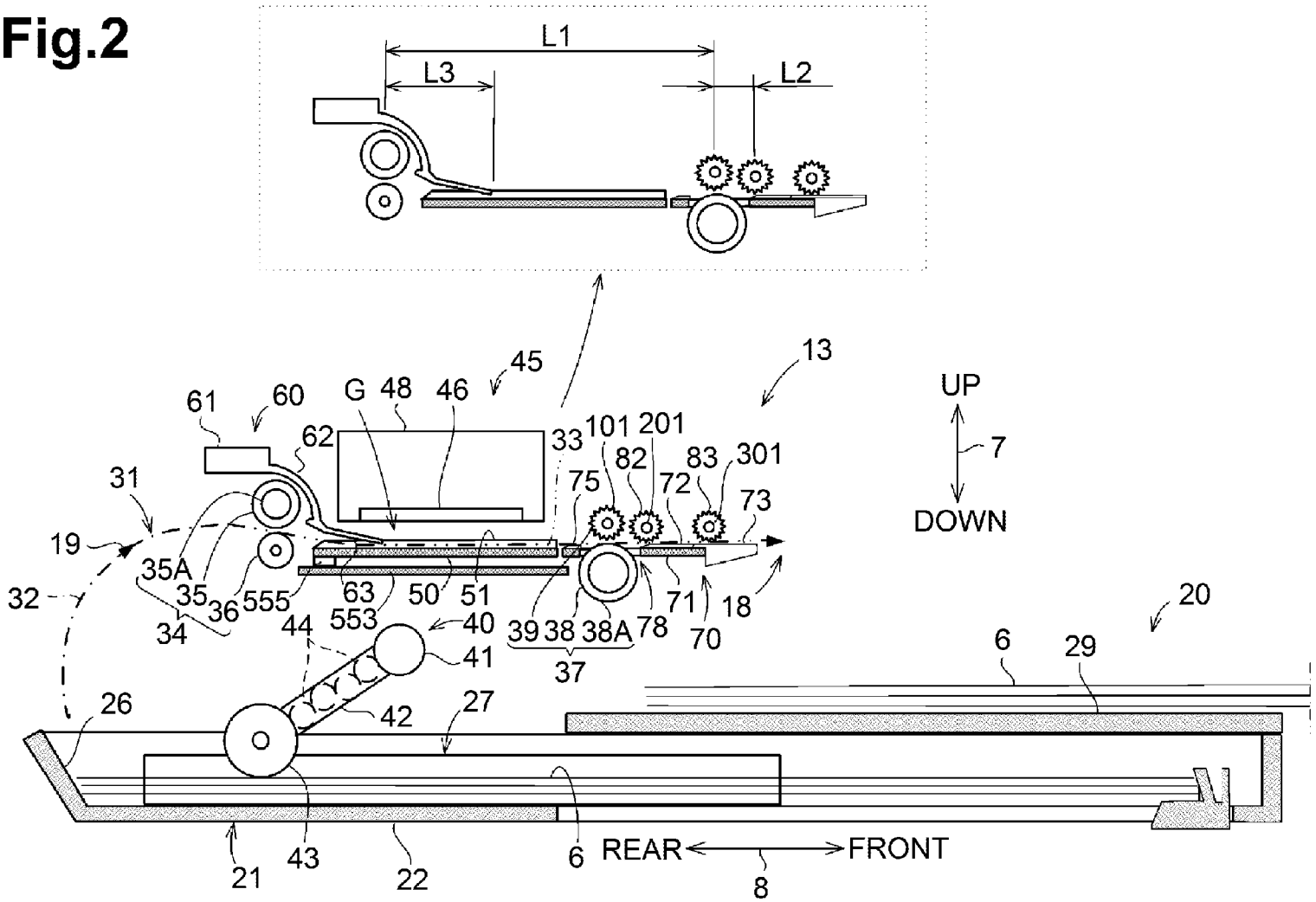
FIG. 2 is a schematic vertical sectional view depicting a main body of the inkjet recording apparatus of FIG. 1 in the first illustrative embodiment.

As further depicted in FIG. 1, the printer unit 11 may comprise a main body 13 and a sheet feed cassette 20. The sheet feed cassette 20 may be disposed in a lower portion of the main body 13. As depicted in FIG. 2, the sheet feed cassette 20 may be configured to accommodate one or more sheets 6 that may be loaded therein by a user. The main body 13 may comprise a housing 14 (see FIG. 1) that may comprise therein a feeding portion 40, a conveying path 31, a conveyor roller pair 34, a discharge roller pair 37, contact members 60, a recording portion 45, second spurs 82 and third spurs 83. The main body 13 may be configured to feed the sheet 6 into the conveying path 31 by the feeding portion 40 and convey the fed sheet 6 by the conveyor roller pair 34. The main body 13 may be further configured to form the sheet 6 being conveyed into a shape of alternating ridge portions and groove portions (hereinafter, also referred to as a "corrugated shape") to provide a corrugation pattern. For example, the corrugated shape of the sheet 6 may be formed by the contact members 60. Consequently, the main body 13 may record an image onto the sheet 6 having a corrugation pattern by ejecting ink droplets from the recording portion 45. A sheet having a corrugation pattern may also be referred to as a "corrugated sheet". The main body 13 may be further configured to maintain the sheet 6 in the corrugated shape by the discharge roller pair 37, the second spurs 82 and the third spurs 83 and to discharge the sheet 6 onto a sheet discharge tray 29 of the sheet feed cassette 20 by the discharge roller pair 37. Hereinafter, components of the printer unit 11 are described.

The housing 14 may have an opening 15 in the front of the housing 14 in the front-rear direction 8. The sheet feed cassette 20 may be inserted into or removed from the inkjet recording apparatus 10 via the opening 15. The housing 14 may comprise rails (not depicted) at a back portion of the housing 14 behind the opening 15. The rails may be configured to support the sheet feed cassette 20 slidably along the front-rear direction 8.

The sheet feed cassette 20 may be configured to be accommodated in the lower portion of the housing 14. The sheet feed cassette 20 may be supported by the rails (not depicted) disposed at the housing 14 and configured to be slidable along the front-rear direction 8 via the rails. As depicted in FIG. 2, the sheet feed cassette 20 may comprise a main tray 21 and the sheet discharge tray 29. The main tray 21 may be configured to hold one or more sheets 6 on which an image is to be recorded. The sheet discharge tray 29 may be configured to receive one or more sheets 6 on which an image has been recorded. The sheet discharge tray 29 may be disposed above the main tray 21 and supported by the main tray 21.

Figure 11A:
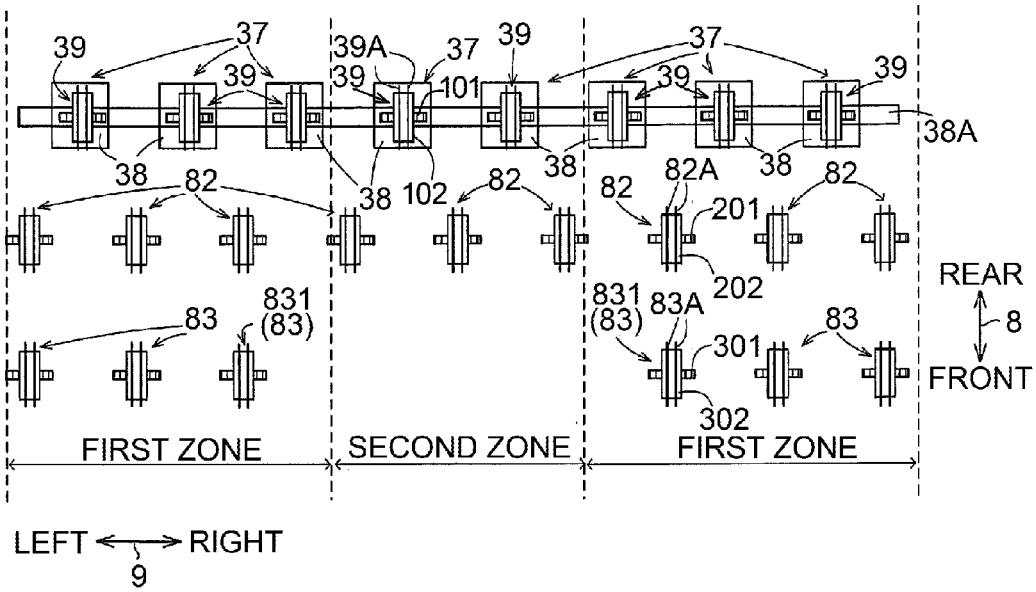
FIG. 11A is schematic plan view depicting positions of a discharge roller pair, second spurs, and third spurs in the first illustrative embodiment.
Figure 11B:
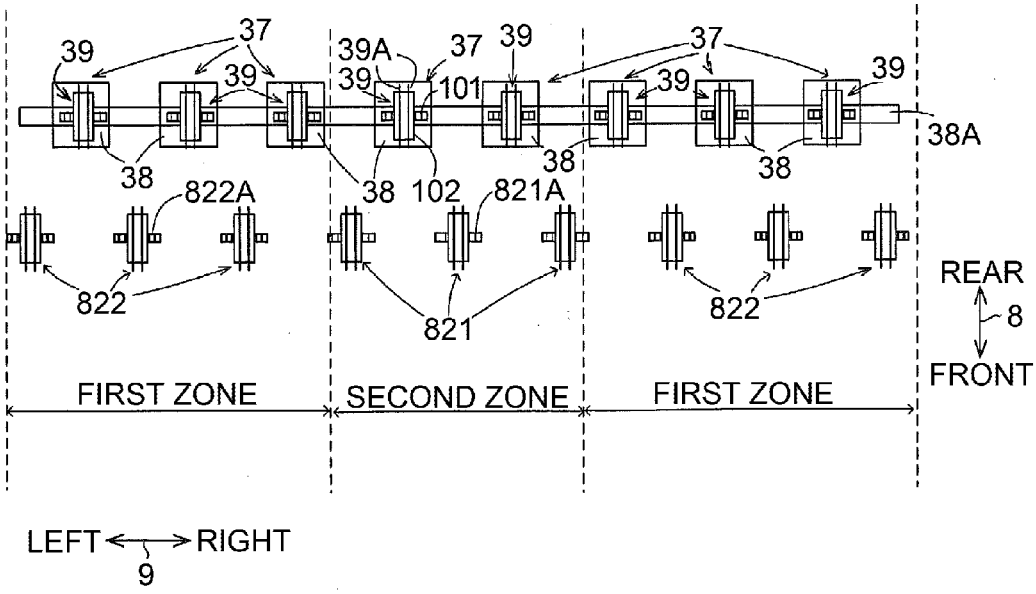
FIG. 11B is a schematic plan view depicting positions of a discharge roller pair and second spurs in another embodiment according to one or more aspects of the disclosure.

The main tray 21 may comprise a lower surface 22 and an inclined wall 26. One or more sheets 6 may be received on the lower surface 22 of the main tray 21. The inclined wall 26 may extend obliquely upward from a rear end of the lower surface 22 in the front-rear direction 8. The inclined wall 26 may be configured to allow the one or more sheets 6 to move obliquely upward into the conveying path 31 from the feeding portion 40. A side guide mechanism 27 may be disposed on the lower surface 22. The side guide mechanism 27 may be configured to center the one or more sheets 6 received on the lower surface 22 (center alignment). In the center alignment, one or more sheets 6 of any size may be positioned on the lower surface 22 while the center line of the one or more sheets 6 with respect to the right-left direction 9 may be aligned with the center line of the main tray 21 with respect to the right-left direction 9. Sheets from L size (equivalent to 3R size) to A4 size may be loaded on the lower surface 22 of the main tray 21. L-size sheets, postcards, 2L-size sheets, and A5 sheets may be loaded on the lower surface 22 with their long sides oriented parallel to the front-rear direction 8 such that the side guide mechanism 27 contacts and positions the long sides of the sheets. The long side of an A5 sheet may be a maximum dimension in the front-rear direction 8 loadable on the lower surface 22. A4 sheets 6 may be loaded on the lower surface 22 with their short sides oriented parallel to the front-rear direction 8. An A4 sheet may be a maximum size sheet loadable on the lower surface 22. In the first illustrative embodiment, the inkjet recording apparatus 10 defines a first zone configured to receive passage of an A4 sheet (as an example of a first sheet) but not passage of an A5 sheet (as an example of a second sheet), and a second zone configured to receive passage of an A5 sheet and an A4 sheet. As depicted in FIGS. 11A and 11B, the second zone is defined in the central portion in the right-left direction 9 while the first zone is defined in outer portions than the second zone in the right-left direction 9. In other words, the second zone is defined between a first part and a second part of the first zone in the right-left direction 9.

The feeding portion 40 may comprise a support shaft 41, an arm 42, and a feed roller 43. The support shaft 41 may be rotatably supported by a frame (not depicted). The arm 42 may extend obliquely downward from the support shaft 41. One end of the arm 42 may be rotatably supported by the support shaft 41 and the other end of the arm 42 may rotatably support the feed roller 43. The arm 42 may comprise a plurality of gears 44 for transmitting the rotation of the support shaft 41 to the feed roller 43.

The feed roller 43 may be configured to be rotatable by a force generated by the rotation of the support shaft 41 and transmitted through the plurality of gears 44. The feed roller 23 may be configured to feed the one or more sheets 6, one by one, from the main tray 21 toward the rear with respect to the front-rear direction 8 with the rotation of the feed roller 43. The fed sheet 6 may be allowed to move into the conveying path 31 by the inclined wall 26 of the main tray 21.

As depicted in FIG. 2, the conveying path 31 may be defined by a plurality of guide members, including a support member 70, and a platen 50. The guide members other than the support member 70 are omitted from the drawings. The conveying path 31 may comprise a curved section 32, which is indicated by a dotted and dashed line, and a straight section 33, which is indicated by a double-dotted and dashed line. The curved section 32 may extend upward from an upper end of the inclined wall 26 of the main tray 21 and be curved toward the front in the front-rear direction 8. The straight section 33 may extend from an end of the curved section 32 toward the front in the front-rear direction 8. The support member 70 is described in further detail below.

Figures 5A, 5B, 5C:
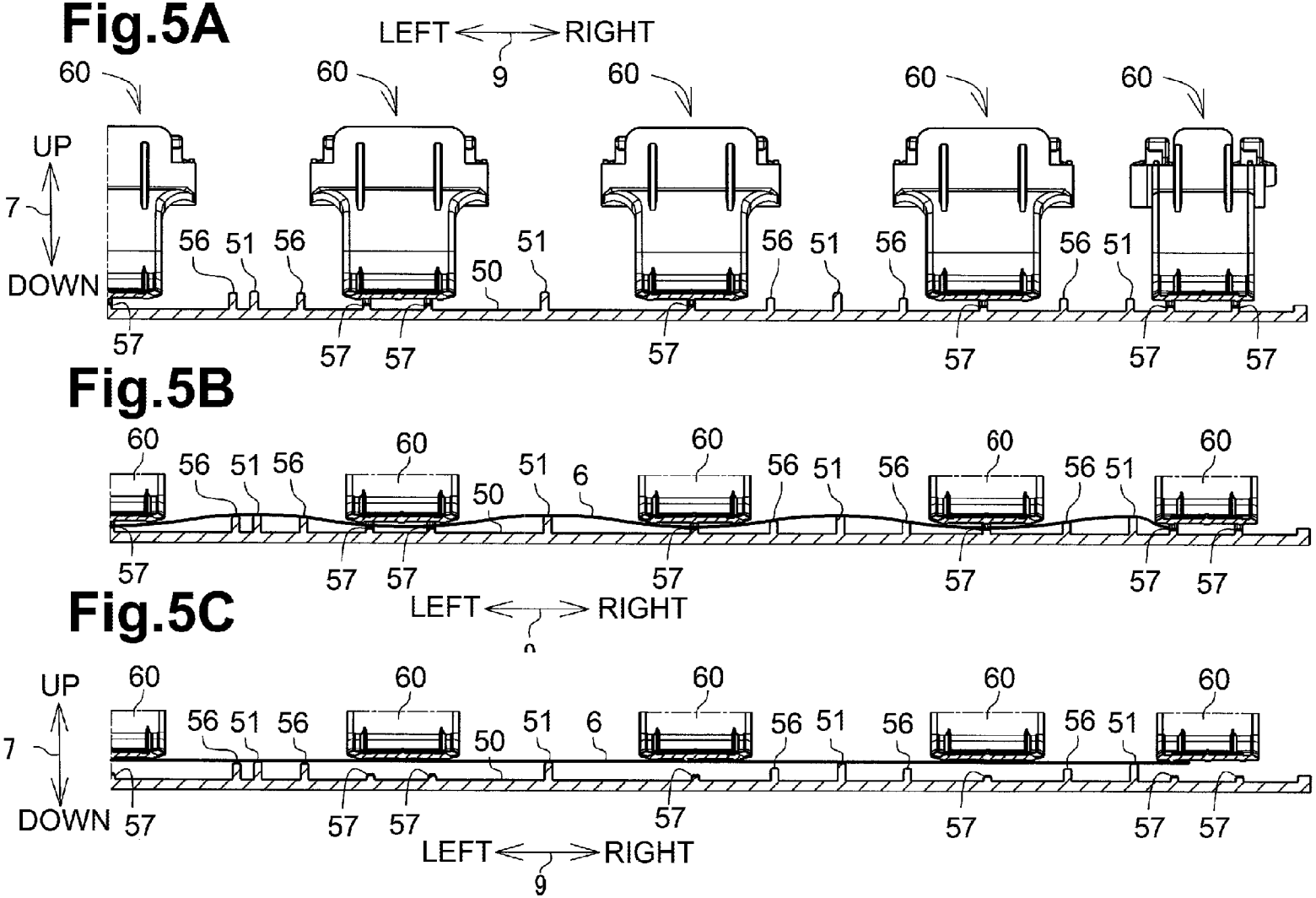
FIG. 5A is a sectional view depicting a platen and contact members, taken along a line extending in a right-left direction, in the first illustrative embodiment.
FIG. 5B is a sectional view depicting the platen and the contact members when a sheet having relatively lower stiffness is conveyed, taken along the line extending in the right-left direction, in the first illustrative embodiment.
FIG. 5C is a sectional view depicting the platen and the contact members when a sheet having relatively higher stiffness is conveyed, taken along the line extending in the right-left direction, in the first illustrative embodiment.

The platen 50 may have a plate-like shape having a thickness in the up-down direction 7. The platen 50 may be disposed above the sheet feed cassette 20. As depicted in FIG. 5A, the platen 50 may comprise a plurality of first ribs 51 (as an example of a rib), a plurality of eighth ribs 56, and a plurality of other ribs 57 that may upwardly protrude from an upper surface of the platen 50.

Figure 6:
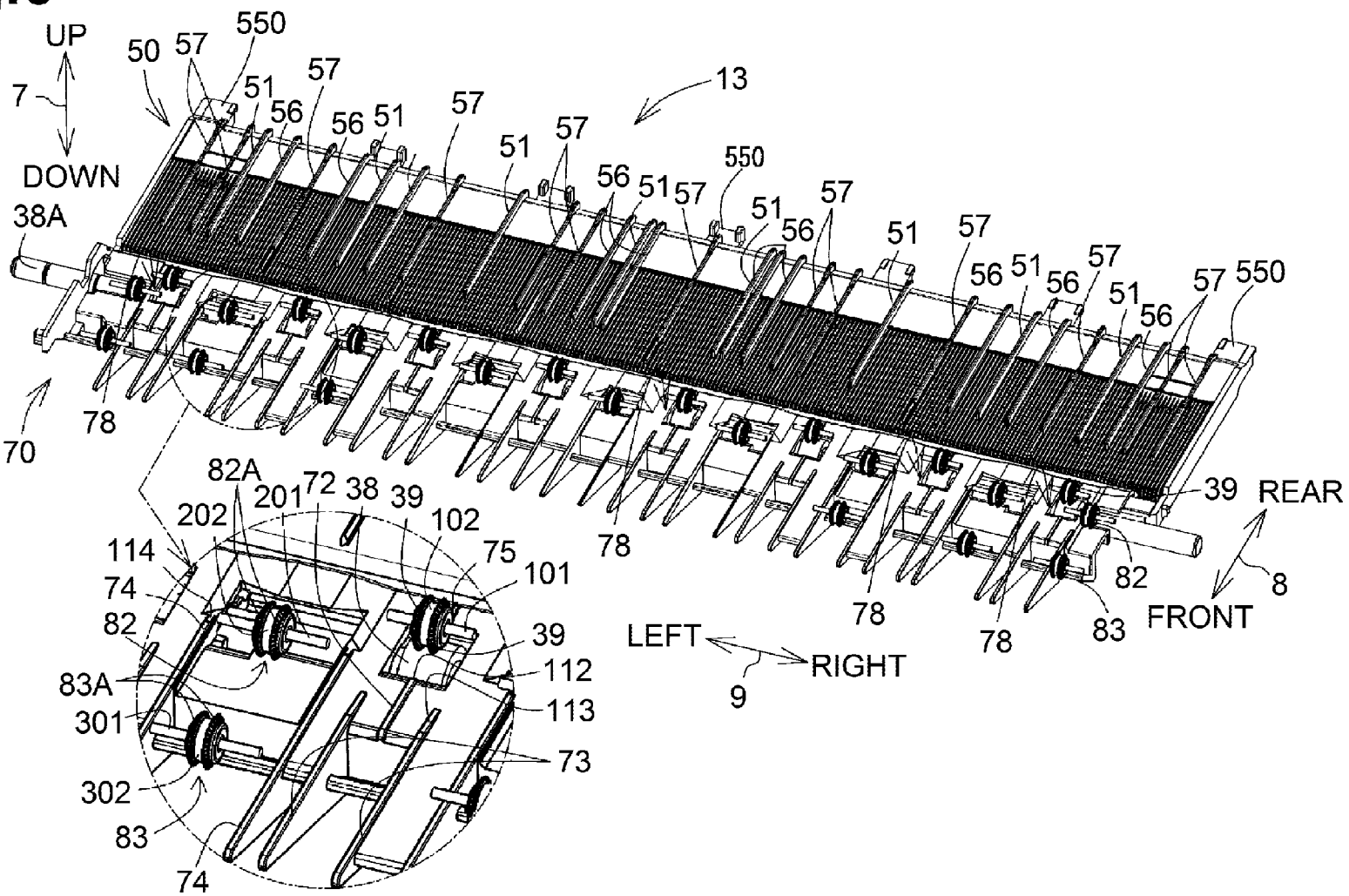
FIG. 6 is a perspective view depicting the platen and a support member, in the first illustrative embodiment.

The first ribs 51 may be provided and configured to hold the sheet 6 to form ridge portions in the sheet 6. As depicted in FIG. 6, the first ribs 51 may extend along the front-rear direction 8 from a rear end of the platen 50 to the vicinity of a front end of the platen 50. With this configuration, the first ribs 51 may hold the ridge portions of the corrugated sheet 6 to the vicinity of the front end of the platen 50.

The first ribs 51 may be spaced apart from each other in the right-left direction 9 (as an example of a first direction) and disposed at diametrically opposed positions about the center line of the platen 50 in the right-left direction 9. This configuration may provide a symmetric corrugation pattern in the sheet 6 of any size, which may be centered by the side guide mechanism 27, with respect to the center line of the sheet 6. The symmetric pattern may reduce a tendency of the corrugation pattern in the sheet 6 to be deformed and improve image-recording accuracy. A recording head 46 may be configured to eject ink droplets onto the sheet 6 based on a distance between the sheet 6 and each nozzle 47 (see FIG. 3) that may be changeable due to the corrugation pattern formed in the sheet 6. Therefore, the image-recording accuracy may be improved when the corrugation pattern of the sheet 6 is maintained.

The eighth ribs 56 may be provided for adjusting the shape of respective curves (curvature radiuses) of the corrugation pattern formed in the sheet 6. As depicted in FIG. 5A, each of the eighth ribs 56 may be disposed between each of the first ribs 51 and each of the contact members 60 in the right-left direction 9. The eighth ribs 56 may extend along a conveying direction 19 of the sheet 6 (see FIG. 2). Each of the contact members 60 may be disposed at a middle position between two adjacent ribs of the first ribs 51 in the right-left direction 9.

The eighth ribs 56 may be shorter in height than the first ribs 51 such that portions of the sheet 6 held by the respective eighth ribs 56 do not become the tops or crests of the ridge portions in the corrugation pattern. Each of the eighth ribs 56 may hold a portion of the sheet 6 between a ridge portion and a groove portion of each curve in the corrugation pattern to adjust and/or maintain the curvature radius of each curve in the corrugation pattern of the sheet 6.

The ribs 57 may be provided and configured to hold or support the groove portions of the corrugated sheet 6. Upper edges of the ribs 57 may be located lower than upper edges of the eighth ribs 56 (e.g., the height of ribs 57 may be smaller than the height of eighth ribs 56). Each of the ribs 57 may extend from a position under a downstream end of a contact portion 63 of a corresponding one of the contact members 60 with respect to the conveying direction 19 (see FIG. 2) to the front end of the platen 50 in the front-rear direction 8.

Some of the ribs 57 may be disposed at a middle position under a corresponding one of the contact members 60 in the right-left direction 9. These ribs 57 may hold bottoms of the groove portions (e.g., the troughs), respectively, of the corrugated sheet 6. Pairs of ribs of the rest of the ribs 57 may be spaced apart from each other under a corresponding one of the contact portions 63 in the right-left direction 9. These ribs 57 may be configured to hold the right and left portions of the bottom of each of the groove portions of the corrugated sheet 6. The corrugated sheet 6 may be conveyed over the platen 50 while the ridge portions are held by the first ribs 51 and the groove portions are held by the ribs 57. Therefore, the tendency of the corrugation pattern of the sheet 6 to be deformed may be reduced.

Figure 13:
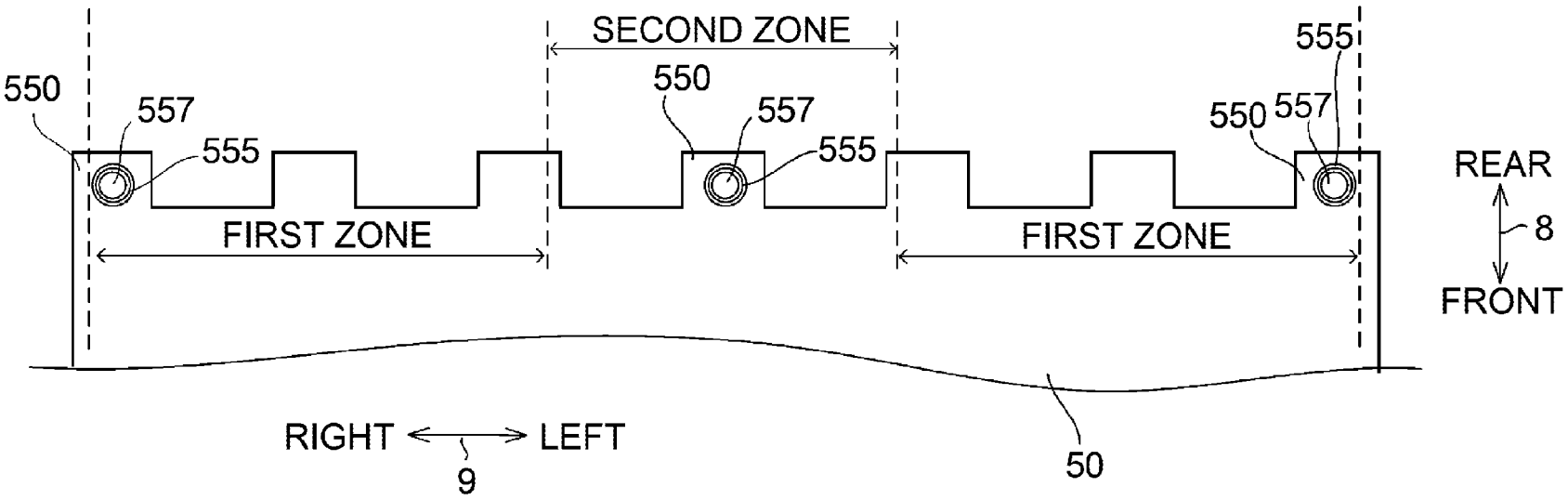
FIG. 13 is a schematic back view of the platen in the first illustrative embodiment.

The platen 50 may be pivotably supported by a rotating shaft 38A of discharge rollers 38 (see FIG. 2) at the front end of the platen 50 with respect to the front-rear direction 8. With this configuration, the platen 50 may allow a sheet 6 having relatively higher stiffness to pass therethrough without forming a corrugated shape in the sheet 6 (see FIG. 5C). The platen 50 may be configured to pivot between a first position depicted in FIG. 5A and a second position depicted in FIG. 5C. As depicted in FIGS. 6 and 13, in the first illustrative embodiment, the platen 50 may include projections 550 projecting rearward from a rear end thereof. One of the projections 550 may be disposed at a center of the platen 50 in the right-left direction 9, and other projections 550 may be arranged symmetrically relative to the projection 550 at the center. Each of the projection 550 at the center and opposite ends in the right-left direction 9 may include a protrusion 557 formed, on a lower surface thereof, for receiving an urging spring 55 as an elastic member. The other end of the urging spring 55 may be supported by a frame 553 (depicted in FIG. 2). With this configuration, the platen 50 may be urged toward the first position (upward). When the sheet 6 having relatively higher stiffness is conveyed, the platen 50 may be pivoted from the first position to the second position by the sheet 6 against urging force of the urging springs 55. The two projections 550 at the opposite ends may be positioned outer than the second zone in the right-left direction 9 and within the first zone. Sheets 6 of smaller sizes (e.g. L-size sheet, postcard, and 2L-size sheet) may pass through the second zone. A sheet 6 of A4 size, which may be a maximum size for the first zone, may pass through the first zone. Thus, when a smaller size sheet 6 having a relatively higher stiffness 6 is conveyed, an urging force of the urging spring 555 at the center may only act on the smaller size sheet 6 through the platen 50. This may prevent skewing of the smaller size sheet 6.

Figure 4:
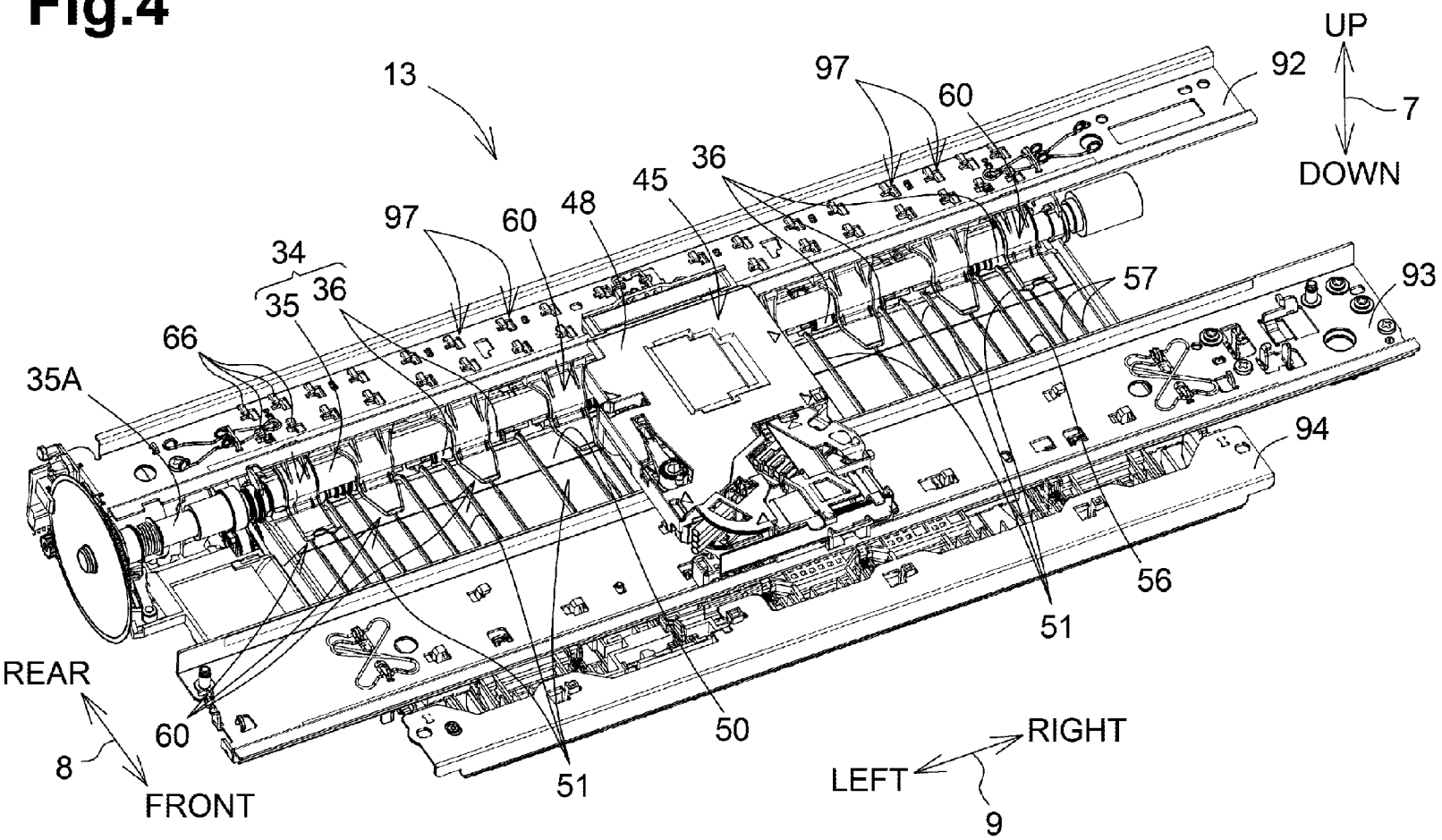
FIG. 4 is a partial perspective view depicting the main body in the first illustrative embodiment.

Referring again to FIG. 2, the recording portion 45 may comprise a carriage 48 disposed above the platen 50, and the recording head 46 mounted on the carriage 48. Referring to FIG. 4, the carriage 48 may be supported by a pair of front and rear guide rails 92, 93 disposed above the platen 50 and may be configured to reciprocate along the right-left direction 9. The guide rails 92, 93 may be supported by the frame (not depicted) at both ends, respectively, with respect to the right-left direction 9. The guide rail 93 may be provided with a belt (not depicted) to which the carriage 48 may be fixed. The belt may be configured to be rotated by a drive motor (not depicted) to allow the carriage 48 to reciprocate along the right-left direction 9.

Figure 3:
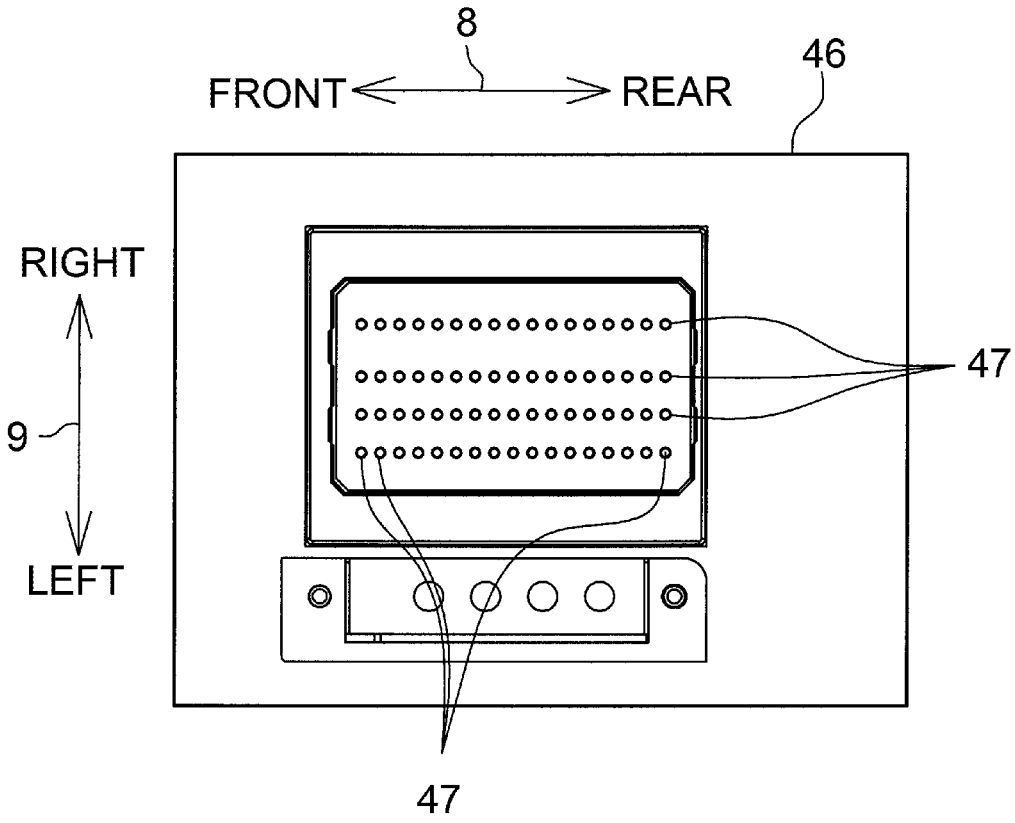
FIG. 3 is a bottom view depicting a recording head in the first illustrative embodiment.

As depicted in FIG. 2, the recording head 46 may be mounted on the carriage 48, and disposed above the platen 50 while leaving a gap G between the recording head 46 and the platen 50. In FIG. 3, the recording head 46 is shown with the plurality of nozzles 47 in a lower surface of the recording head 46 to eject ink droplets therefrom. The recording head 46 may be configured to record an image onto a sheet 6 by ejecting ink droplets from the nozzles 47 onto the sheet 6 held by the platen 50.

As depicted in FIG. 2, a conveyor roller pair 34 (as an example of a first conveyor) may be disposed upstream of the platen 50 with respect to the conveying direction 19 (behind the platen 50 in the front-rear direction 8). The conveyor roller pair 34 may be configured to nip the sheet 6 fed from the feeding portion 40 and convey the sheet 6 along the conveying direction 19.

The conveyor roller pair 34 may comprise a rotating shaft 35A, a conveyor roller 35, and following rollers 36. The rotating shaft 35A may extend along the right-left direction 9 (a direction perpendicular to the drawing sheet of FIG. 2). The conveyor roller 35 may be disposed on the rotating shaft 35A and may be configured to rotate integrally with the rotating shaft 35A. The following rollers 36 may be disposed below the conveyor roller 35. The rotating shaft 35A may be supported by the frame (not depicted) at both ends of the rotating shaft 35A with respect to the right-left direction 9 and configured to be rotated by a drive motor (not depicted).

The following rollers 36 may be rotatably supported by a holding member (not depicted). The holding member may be urged upward by one or more elastic members (not depicted). The following rollers 36 may be in pressure contact with the conveyor roller 35, which may be disposed above the following rollers 36, by the one or more elastic members. The conveyor roller pair 34 may be configured to nip the sheet 6 by the conveyor roller 35 and the following rollers 36 and convey the sheet 6 along the conveying direction 19. The sheet 6 being conveyed may be formed into a corrugated shape by the first ribs 51 of the platen 50 and the contact members 60.

As depicted in FIG. 4, the contact members 60 (as an example of a corrugate mechanism, a pressing portion, and a third pressing portion) may be attached to the guide rail 92 and spaced apart from each other in the right-left direction 9. Each of the contact members 60 may be disposed at the middle position between ribs of the first ribs 51 adjacent in the right-left direction 9. This configuration may form ridge portions and groove portions alternately at regular intervals in the sheet 6. Accordingly, the tendency of the corrugation pattern in the sheet 6 to be deformed may be reduced and the image-recording accuracy may be improved.

A structure of the contact members 60 is now described with reference to FIG. 2. In one or more examples, all of the contact members 60 may have the same configuration, and therefore, the description of one of the contact member 60 may apply to a remainder of the contact members 60. The contact member 60 may comprise a fixing portion 61, a curved portion 62, and the contact portion 63. The fixing portion 61 may be configured to be attached to the guide rail 92 (see FIG. 4). The curved portion 62 may curvedly extend downward from the fixing portion 61 such that the curved portion 62 does not come into contact with the conveyor roller 35. The contact portion 63 may extend from a lower end of the curved portion 62 such that the contact portion 63 may extend toward the gap G.

The fixing portion 61 may comprise protrusions (not depicted) to be inserted from below into respective insertion openings 97 (see FIG. 4) provided in the guide rail 92. As depicted in FIG. 4, each of the protrusions may comprises a pawl 66 at its upper end. The pawls 66 may engage an upper surface of the guide rail 92. The fixing portion 61 may be fixed to the guide rail 92 by sandwiching the guide rail 92 from above and below by an upper end surface of the fixing portion 61 and the pawls 66.

The contact portion 63 may have a plate-like shape that may extend obliquely downward from a tip end, e.g., a front end of the curved portion 62. A forward part of the contact portion 63, with respect to the conveying direction, may be located closer to the upper surface of the platen 50 than a back part of the contact portion 63. In one example, the contact portion 63 becomes gradually closer to the upper surface of the platen 50 from a back part to a forward part of the contact portion 63. A lower end of the contact portion 63 (e.g., a front end of the contact portion 63 in the front-rear direction 8) may be located in the gap G and adjacent to the nozzles 47 (see FIG. 3).

As depicted in FIG. 5A, the lower end of the contact portion 63 may be located lower than the upper edges of the first ribs 51 of the platen 50 located in the first position. The sheet 6 to be conveyed over the platen 50 may be formed into a corrugated shape by the first ribs 51 and the contact portions 63. For example, the sheet 6 may have ridge portions that may be held by the first ribs 51 and groove portions that may be depressed by the contact portions 63. The corrugated sheet 6 may be conveyed over the platen 50 without curling, and an image may be recorded on the sheet 6 by the recording head 46. The sheet 6 on which the image has been recorded may then reach the discharge roller pair 37 and be further conveyed by the discharge roller pair 37.

As depicted in FIG. 2, the discharge roller pair 37 (as an example of a second conveyor) may comprise the rotating shaft 38A, the plurality of discharge rollers 38, and a plurality of first spurs 39. The rotating shaft 38A may be disposed downstream of the platen 50 with respect to the conveying direction 19 (in front of the platen 50 with respect to the front-rear direction 8). The plurality of discharge rollers 38 may be disposed on the rotating shaft 38A. The plurality of first spurs 39 may be disposed above the respective discharge rollers 38. The discharge rollers 38 may be spaced from each other in an axial direction of the rotating shaft 38A. In the first illustrative embodiment, eight discharge rollers 38 and eight first spurs 39 may be disposed in the right-left direction 9. Six discharge rollers 38 and six first spurs 39 may be positioned in the first zone, while two discharge rollers 38 and two first spurs 39 may be positioned in the second zone.

Figure 7:
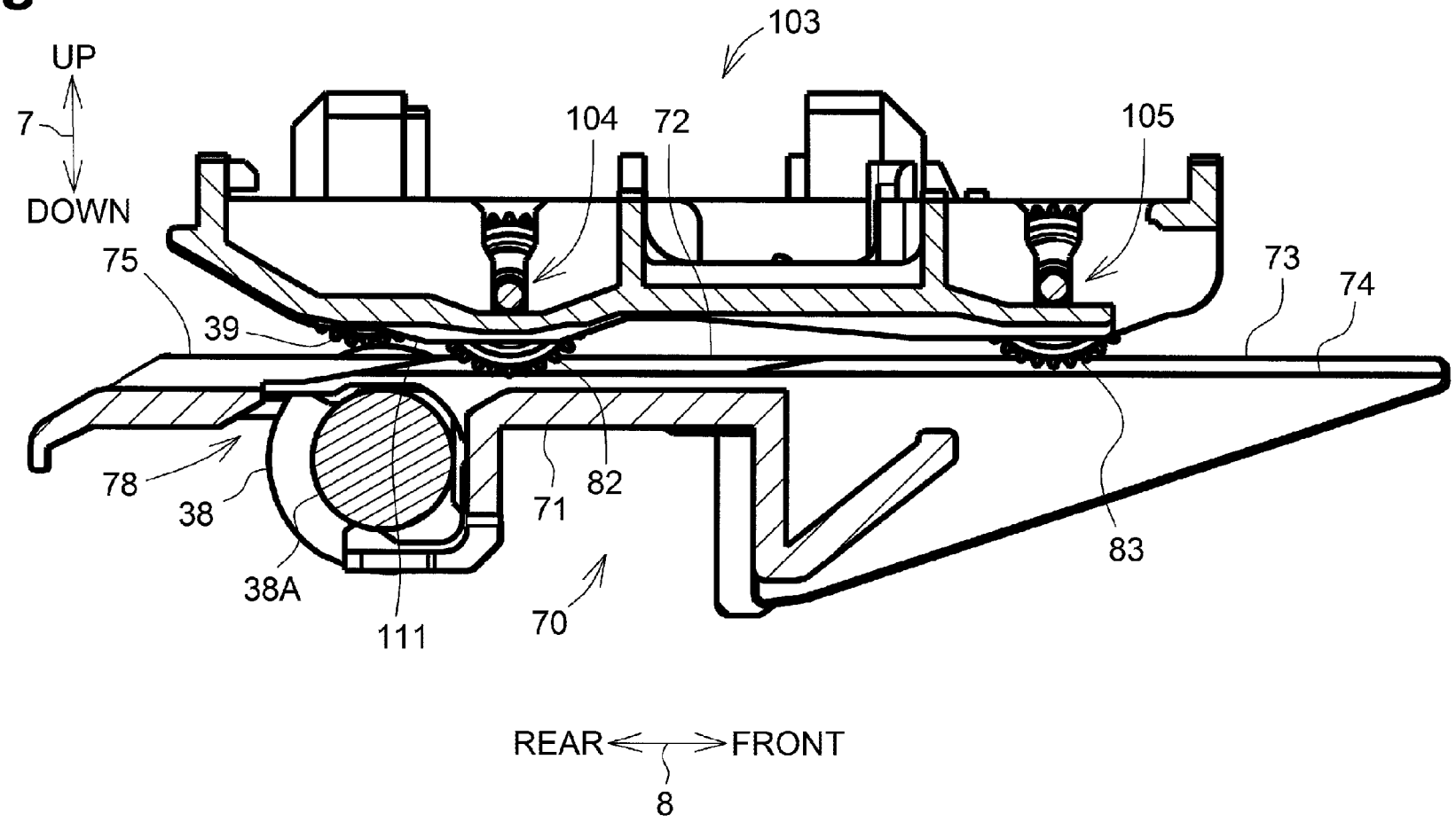
FIG. 7 is a vertical sectional view depicting the support member and a holder in the first illustrative embodiment.

The rotating shaft 38A may extend along the right-left direction 9 (the direction perpendicular to the drawing sheet of FIG. 2). The rotating shaft 38A may be rotatably supported by the frame (not depicted) at both ends. The rotating shaft 38A may be configured to be rotated by the drive motor (not depicted). As depicted in FIG. 7, the rotating shaft 38A may be located such that nip points of the discharge roller pair 37 may be located slightly higher than upper edges of fifth ribs 75 (described later). This configuration may allow the sheet 6 to move such that the tops of the ridge portions of the corrugated sheet 6 held by the fifth ribs 75 may fall on and contact the respective nip points of the discharge roller pair 37.

As depicted in FIGS. 6 and 11A, the first spurs 39 may be rotatably disposed on elastic shafts 101, respectively. The elastic shafts 101 may each have elasticity with respect to a diameter direction. More specifically, each of the first spurs 39 may include a pair of spurs 39A fixed to a spacer 102 so as to be spaced from each other in the right-left direction 9. The pair of spurs 39A and the spacer 102 have a hole penetrating a center thereof. The elastic shaft 101, which may be a coil spring extending in the right-left direction 9, may be inserted into the hole so as to rotatably support the first spur 39. Both ends of the elastic shaft 101 in the right-left direction 9 may be held by a holder 103 (see FIG. 7). The elastic shaft 101 may be configured to be deformed such that a middle part of the elastic shaft 101 in the right-left direction 9 may be located higher than both ends of the elastic shaft 101 when the pair of spurs 39A is in contact with the corresponding discharge roller 38. In this state, the elastic shaft 101 may urge the pair of spurs 39A downward. The first spur 39 may be in pressure contact with the corresponding discharge roller 38 by an urging force of the elastic shaft 101. Accordingly, a lower end of each first spur 39 and an upper end of each discharge roller 38 may nip the sheet 6. In some arrangements, all of the pairs of spurs 39A and the elastic shafts 101 may have the same configuration.

As depicted in FIG. 6, the discharge roller pair 37 may be disposed such that the nip points of the discharge roller pair 37 may be disposed on extensions of the first ribs 51, respectively, along the conveying direction 19 (see FIG. 2) (in front of the respective first ribs 51 in the front-rear direction 8). After the first ribs 51 hold/contact the tops of the ridge portions of the corrugated sheet 6, respectively, the discharge roller pair 37 may nip the tops of the ridge portions of the corrugated sheet 6 as the tops of the ridge portions reach the nip points of the discharge roller pair 37. In other words, the discharge rollers 38 and the first spurs 39 of the discharge roller pair 37 may be spaced, in the front-rear direction 8, from the respective first ribs 51 configured to form the ridge portions of the corrugated sheet 6.

As depicted with a dashed line in FIG. 2, a distance L1 between the nip points of the conveyor roller pair 34 and the respective nip points of the discharge roller pair 37 in the conveying direction 19 may be shorter than a length of a longer side of a sheet 6 having the shortest length, in the conveying direction 19, useable by the image forming apparatus. Therefore, a downstream edge of a sheet 6 of any size may be nipped by the discharge roller pair 37 before an upstream edge of the sheet 6 passes the nip points of the conveyor roller pair 34 with respect to the conveying direction 19.

As depicted in FIG. 7, the holder 103 may be disposed above the discharge rollers 38 and may extend along the conveying direction 19 (see FIG. 2). The holder 103 may be fixed to an upper plate 94 (see FIG. 4). The upper plate 94 may be supported by the frame (not depicted) at its both ends with respect to the right-left direction 9.

As depicted in FIG. 7, the holder 103 may comprise a plurality of first fixing portions (not depicted), a plurality of second fixing portions 104, and a plurality of third fixing portions 105. The plurality of first fixing portions may be configured to fix both ends of the elastic shafts 101 (see FIG. 6) of the first spurs 39, respectively, with respect to the right-left direction 9. The plurality of second fixing portions 104 may be configured to fix both ends of elastic shafts 201 of second spurs 82, respectively, with respect to the right-left direction 9. The plurality of third fixing portions 105 may be configured to fix both ends of elastic shafts 301 of third spurs 83, respectively, with respect to the right-left direction 9. In one or more examples, the first fixing portions, the second fixing portions 104, and the third fixing portions 105 may have the same configuration, and therefore, description will be made regarding the second fixing portions 104. Each of the second fixing portions 104 may be formed into such a groove as to sandwich a corresponding one of the elastic shafts 201 in the front-rear direction 8 and to support the elastic shaft 201 from below. The second fixing portion 104 may include a pressing portion (not depicted) for pressing the elastic shaft 201 from above. The second fixing portion 104 may include a wall portion (not depicted) for restricting the elastic shaft 201 from moving in the right-left direction 9. Accordingly, the second spurs 82 may be held in position by the respective second fixing portions 104 of the holder 103.

The first fixing portions may be disposed above the respective discharge rollers 38 and spaced apart from each other in the right-left direction 9. The second fixing portions 104 may be disposed on extensions of the contact portions 63, respectively, and downstream of the first fixing portions in the conveying direction 19 (in front of the first fixing portions with respect to the front-rear direction 8). The second fixing portions 104 may be spaced apart from each other in the right-left direction 9. The third fixing portions 105 may be disposed on extensions of the second fixing portions 104, respectively, and downstream of the second fixing portions 104 in the conveying direction 19. The third fixing portions 105 may also be spaced apart from each other in the right-left direction 9. The third fixing portions 105 may be disposed downstream of some of the second fixing portions 104 in the conveying direction 19, respectively.

As depicted in FIG. 7, the holder 103 may comprise first guide surfaces 111 for guiding the groove portions of the corrugated sheet 6 to the second spurs 82. The first guide surfaces 111 may be disposed on extensions of the contact members 60, respectively, along the conveying direction 19 (see FIG. 2) such that the first guide surfaces 111 contact respective groove portions formed in the leading edge of the corrugated sheet 6. Each of the first guide surfaces 111 may be located between a corresponding one of the nip points of the discharge roller pair 37 and a lower end of a corresponding one of the second spurs 82 with respect to the conveying direction 19. The first guide surfaces 111 may extend obliquely downward along the front-rear direction 8 from above the nip points of the discharge roller pair 37, respectively. Front ends (lower ends) of the first guide surfaces 111 with respect to the front-rear direction 8 may be located at the same or substantially the same level as the nip points of the discharge roller pair 37 in the up-down direction 7. The leading edge of the sheet 6 being conveyed may come into contact with the first guide surfaces 111 to move obliquely downward. This movement of the sheet 6 will be described in detail later. In other embodiments, for example, the holder 103 may comprise one or more inclined surfaces that may extend obliquely downward along the front-rear direction 8 from a position upstream of the nip points of the discharge roller pair 37 with respect to the conveying direction 19.

The second spurs 82 (as an example of a first pressing portion and an upstream pressing portion) and the third spurs 83 (as an example of a first pressing portion and a downstream pressing portion) may be provided for maintaining the corrugation pattern of the sheet 6 by pressing the bottoms of the groove portions of the corrugated sheet 6 from above. In other words, the second spurs 82 and the third spurs 83 may be spaced, in the front-rear direction 8, from the respective contact portions 63 configured to form the groove portions of the corrugated sheet 6. In some examples, and as depicted in FIG. 6, the second spurs 82 and the third spurs 83 may have the same configuration as the first spurs 39 and may be rotatably disposed on the elastic shafts 201, 301, respectively. Therefore, the second spurs 82 and the third spurs 83 may be allowed to retract upward when a sheet 6 having higher stiffness, e.g., glossy paper, is conveyed. The elastic shafts 301 may each have the same spring constant. The elastic shafts 201 may each have the same spring constant that is greater than that of the elastic shaft 301.

Each of the second spurs 82 may include a pair of spurs 82A, and each of the third spurs 83 may include a pair of spurs 83A. The pair of spurs 82A may be fixed to a spacer 202 so as to be spaced from each other in the right-left direction 9. The pair of spurs 83A may be fixed to a spacer 302 so as to be spaced from each other in the right-left direction 9.

The pair of spurs 82A and the spacer 202 have a hole penetrating a center thereof. The elastic shaft 201, which may be a coil spring extending in the right-left direction 9, may be inserted into the hole so as to rotatably support the pair of spurs 82A and the spacer 202. Similarly, the pair of spurs 83A and the spacer 302 have a hole penetrating a center thereof. The elastic shaft 301, which may be a coil spring extending in the right-left direction 9, may be inserted into the hole so as to rotatably support the pair of spurs 83A and the spacer 302. A middle part in the right-left direction 9 between the pair of spurs 82A coupled by the spacer 202 may coincide with a bottom of a corresponding one of the groove portions of the corrugated sheet 6. The pair of spurs 82A and the pair of spurs 83A may scatter or distribute a sheet pressing force of the second spur 82 and a sheet pressing force of the third spur 83, respectively.

As depicted in FIG. 6, the second spurs 82, e.g., nine second spurs 82, may be arranged in the right-left direction 9. The second spurs 82 may be held by the second fixing portions so as be located at the same positions with respect to the right-left direction 9 as the contact portions 63, respectively. In other words, the second spurs 82 may be disposed downstream of the contact portions 63 in the conveying direction 19, respectively. The second spurs 82 may be configured to press from above the bottoms of the groove portions of the corrugated sheet 6 formed by the contact portions 63 to maintain the sheet 6 in the corrugated shape. As depicted in FIG. 11, the second spurs 82 may be positioned both in the first zone and the second zone. In the first illustrative embodiment, six second spurs 82 may be positioned in the first zone, and three second spurs 82 may be positioned in the second zone.

As depicted in FIG. 6, the third spurs 83, e.g., six third spurs 83 may be arranged in the right-left direction 9. The third spurs 83 may be held by the third fixing portions 105 so as to be located at the same positions with respect to the right-left direction 9 as the second spurs 82 positioned in right and left end portions. In other words, the third spurs 83 may be positioned downstream in the conveying direction 19 of the second spurs 82 positioned in outer (non-central) portions. The third spurs 83, along with the second spurs 82, may be configured to press from above the bottoms of the groove portions of the corrugated sheet 6 formed by the contact portions 63 to maintain the sheet 6 in the corrugated shape. As depicted in FIG. 11A, none of the third spurs 83 may be positioned in the second zone, and six third spurs 83 may be positioned in the first zone.

The second spurs 82 and the third spurs 83 may press from above the bottoms of the groove portions of the corrugated sheet 6 formed by the contact portions 63. Thus, the second spurs 82 and the third spurs 83 may each be disposed at the same position with reference to the right-left direction 9 as the corresponding rib 57 of the platen 50 or as a middle position between the corresponding two adjacent ribs 57. The second spurs 82 and the third spurs 83 may have the same height in the up-down direction 7.

A distance in the right-left direction 9 between two third spurs 831 positioned near the central portion (second zone) may be longer than the short sides of small size sheets 6 (e.g., L-size sheet, postcard, and 2L-size sheet) and shorter than the long side of an A4 sheet 6. Accordingly, the third spurs 83 may not contact the small size sheets 6. A distance in the right-left direction 9 between two spurs 82 positioned in the central portion (second zone) may be shorter than the short sides of the small size sheets 6 (e.g., L-size sheet, postcard, and 2L-size sheet). Accordingly, the second spurs 82 may contact the sheet 6 of any size, but the third spurs 83 may not contact the sheets 6 of predetermined sizes.

The second spurs 82 and the third spurs 83, which are arranged in two rows in the first-rear direction 8 in the first zone, may press the sheet 6 in the first zone, and only the second spurs 82 may press the sheet 6 in the second zone. Accordingly, a pressing force applied to the sheet 6 by the second spurs 82 and the third spurs 83 may be smaller in the second zone than in the first zone. In other words, a pressing force (more specifically, a pressing force per unit area) applied to the sheet 6 by the second spurs 82 and/or the third spurs 83 may be smaller in the second zone than in the first zone.

As depicted in FIG. 7, both ends of the elastic shafts 201 of the second spurs 82 in the right-left direction 9 may be fixed to the second fixing portions 104 of the holder 103, respectively. The lower ends of the second spurs 82 may be located below the nip points of the discharge roller pair 37, respectively, and at the same or substantially the same level as the front ends (the lower ends) of the contact portions 63, respectively, in the front-rear direction 8. Therefore, the second spurs 82 may be configured to press the bottoms of the groove portions of the corrugated sheet 6, respectively, from above.

As depicted by the dashed line in FIG. 2, the second spurs 82 may be disposed such that a distance L2 between the lower ends of the second spurs 82 and the respective nip points of the discharge roller pair 37 in the conveying direction 19 may be shorter than a distance L3 between the nip points of the conveyor roller pair 34 and the respective front ends of the contact portions 63 in the conveying direction 19 (the respective downstream ends of the contact portions 63 with respect to the conveying direction 19). With this configuration, the leading edge of the sheet 6 may reach the second spurs 82 while the upstream edge of the sheet 6, in the conveying direction 19 (hereinafter, simply referred to as the trailing edge of the sheet 6), may be nipped between the first ribs 51 and the contact portions 63 from above and below. Therefore, the upstream part and the downstream part of the sheet 6 with respect to the conveying direction 19 may be maintained in the corrugated shape.

As depicted in FIG. 7, both ends of the elastic shafts 301 of the third spurs 83 with respect to the right-left direction 9 may be fixed to the third fixing portions 105 of the holder 103, respectively. The lower ends of the third spurs 83 may be located below the nip points of the discharge roller pair 37 and at the same or substantially the same level as the lower ends of the contact portions 63, respectively. Therefore, the third spurs 83 may be configured to press the bottoms of the groove portions of the corrugated sheet 6, respectively.

The third spurs 83 may be disposed downstream of the second spurs 82 in the conveying direction 19 (see FIG. 2) and spaced apart from the second spurs 82, respectively. With this configuration, the second spurs 82 and the third spurs 83 may press the respective groove portions of the corrugated sheet 6 at the two points spaced apart from each other in the conveying direction 19. Therefore, the curling of the trailing edge of the sheet 6 on the platen 50 may be reduced after the trailing edge of the sheet 6 passes the contact portions 63. When the distance between the second spurs 82 and the third spurs 83 is too long, the trailing edge of the sheet 6 may pass the contact portions 63 before the leading edge of the sheet 6 reaches the third spurs 83 and thus the sheet 6 may be rotated about the second spurs 82. Therefore, the third spurs 83 may be disposed at the appropriate positions apart from the second spurs 82 such that the leading edge of the sheet 6 having a shortest length in the conveying direction 19 may reach the third spurs 83 before the trailing edge of the sheet 6 passes the contact portions 63.

As depicted in FIG. 2, the support member 70 may be disposed below the holder 103 and configured to hold the sheet 6 to be pressed by the second spurs 82 and the third spurs 83. The sheet 6 may be discharged onto the sheet discharge tray 29 from a discharge port 18 provided downstream of the support member 70 with respect to the conveying direction 19.

As depicted in FIG. 7, the support member 70 may comprise a plate-shaped base 71, a plurality of second ribs 72, a plurality of third ribs 73, a plurality of fourth ribs 74, and a plurality fifth ribs 75. The base 71 may be disposed between the rotating shaft 38A and the holder 103 and fixed to the frame (not depicted). The second ribs 72, the third ribs 73, the fourth ribs 74 and the fifth ribs 75 may protrude from an upper surface of the base 71. As depicted in FIG. 6, the base 71 may have a plurality of openings 78. The discharge rollers 38 may stick out from the upper surface of the base 71 via the openings 78, respectively.

The fifth ribs 75 may be provided for guiding the tops of the ridge portions of the corrugated sheet 6 to the nip points of the discharge roller pair 37. Each of the fifth ribs 75 may extend from the midpoint (with respect to the right-left direction 9) of an upstream edge (with respect to the conveying direction 19 (see FIG. 2)) of a corresponding one of the openings 78 (e.g., a rear edge of the opening 78 with respect to the front-rear direction 8) to an upstream end of the base 71 with respect to the conveying direction 19 (the rear end of the base 71 with respect to the front-rear direction 8). Therefore, the fifth ribs 75 may be disposed on extensions of the first ribs 51, respectively, with respect to the conveying direction 19. Upper edges of the fifth ribs 75 may be located at the substantially same level as the upper edges of the first ribs 51. Therefore, the fifth ribs 75 may hold the tops of the ridge portions of the corrugated sheet 6, respectively. The platen 50 may have the pivotable configuration. Thus, the first ribs 51 of the platen 50 may not be able to extend to the nip points of the discharge roller pair 37. Accordingly, the holder 103 may need to be provided with the fifth ribs 75.

Figure 8A:
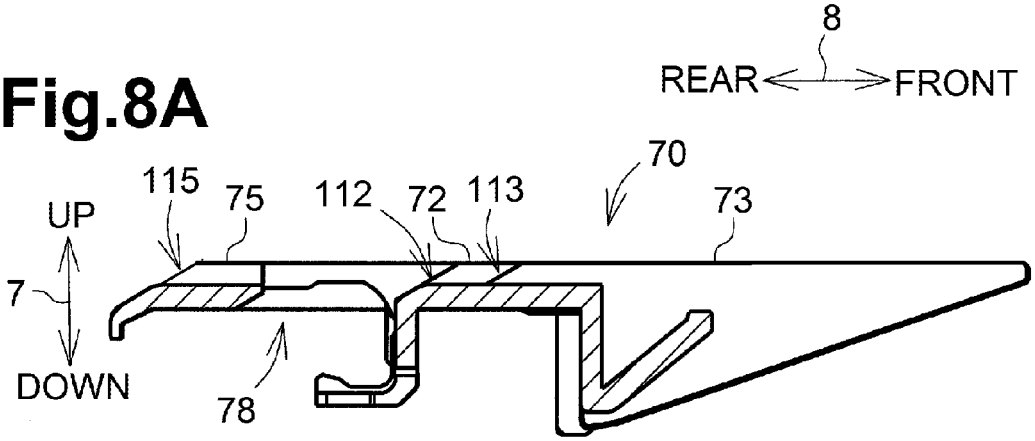
FIG. 8A is a vertical sectional view depicting the support member, taken along a line passing one of second ribs and one of fifth ribs, in the first illustrative embodiment.

As depicted in FIG. 8A, each of the fifth ribs 75 may comprise a fifth guide surface 115 at an upstream end of each of the fifth ribs 75 with respect to the conveying direction 19 (see FIG. 2). In each of the fifth ribs 75, the fifth guide surface 115 may extend obliquely upward from an upstream end of the upper surface of the base 71 to an upper edge of the fifth rib 75 with respect to the conveying direction 19. The fifth guide surfaces 115 may come into contact with the leading edge of the sheet 6 to allow the sheet 6 to move to the upper edges of the fifth ribs 75. This configuration may reduce catching of the sheet 6 on the upstream ends of the fifth ribs 75 with respect to the conveying direction 19.

As depicted in FIG. 6, the second ribs 72 may be provided for holding the tops of the ridge portions of the corrugated sheet 6. The second ribs 72 may be disposed on the extensions of the first ribs 51, respectively, with respect to the conveying direction 19 (see FIG. 2). Upper edges of the second ribs 72 may be located at the same or substantially the same level as the upper edges of the first ribs 51. Therefore, the second ribs 72 may hold the tops of the ridge portions of the corrugated sheet 6, respectively. Each of the second ribs 72 may extend along the conveying direction 19 from the midpoint (with respect to the right-left direction 9) of a downstream edge (with respect to the conveying direction 19) of a corresponding one of the openings 78 (a front edge of the opening 78 with respect to the front-rear direction 8). Upstream ends of the second ribs 72 may be located upstream of the lower ends of the second spurs 82, respectively, with respect to the conveying direction 19 (front ends of the second ribs 72 with respect to the front-rear direction 8). Therefore, the upstream ends of the second ribs 72 with respect to the conveying direction 19 may be located upstream of the lower ends of the second spurs 82. This configuration may allow the second ribs 72 to hold the ridge portions of the corrugated sheet 6 when the second spurs 82 press the groove portions of the corrugated sheet 6 from above. Each of the second ribs 72 may extend from the downstream edge of a corresponding one of the openings 78 to a position between the second spurs 82 and the third spurs 83 along the conveying direction 19 because the third ribs 73 may be provided on the platen 50.

As depicted in FIG. 8A, each of the second ribs 72 may comprise a second guide surface 112 at an upstream end of each of the second ribs 72 with respect to the conveying direction 19 (see FIG. 2). In each of the second ribs 72, the second guide surface 112 may extend obliquely upward from a downstream edge of a corresponding one of the openings 78 to an upper edge of the second rib 72. The second guide surfaces 112 may come into contact with the leading edge of the sheet 6 that has passed the nip points of the discharge roller pair 37, and allow the sheet 6 to move to the upper edges of the second ribs 72. This configuration may reduce catching of the sheet 6 on the upstream ends of the second ribs 72 with respect to the conveying direction 19.

The third ribs 73 may be provided and configured to hold the ridge portions of the corrugated sheet 6 by taking over from the second ribs 72. As depicted in FIG. 6, the third rib 73 may be disposed on both sides of each of the second ribs 72 in the right-left direction 9 such that each pair of third ribs 73 may hold the right and left portions of the top of a corresponding ridge portion of the corrugated sheet 6. The third ribs 73 may extend from respective positions upstream of the downstream ends of the second ribs 72 to respective positions downstream of the second spurs 82 in the conveying direction 19 (see FIG. 2). With this configuration, the third ribs 73 may take over holding the sheet 6 from the second ribs 72. Upper edges of the third ribs 73 may be located lower than the upper edges of the second ribs 72. While the sheet 6 is conveyed, the third ribs 73 may hold the right and left portions of the tops of the ridge portions of the sheet 6, respectively, after the second ribs 72 held the tops of the ridge portions of the sheet 6, respectively. For example, the holding of the right and left portions of the ridge portion tops may transfer from the second ribs 72 to the third ribs 73.

As depicted in FIG. 8A, each of the third ribs 73 may comprise a third guide surface 113 at an upstream end thereof in the conveying direction 19 (see FIG. 2). In each of the third ribs 73, the third guide surface 113 may extend obliquely upward from the upper surface of the base 71 to an upper edge of the third rib 73. The third guide surfaces 113 may come into contact with the leading edge of the sheet 6 to allow the sheet 6 to move to the upper edges of the third ribs 73. This configuration may reduce catching of the sheet 6 on the upstream ends of the third ribs 73 with respect to the conveying direction 19.

The fourth ribs 74 may be provided and configured to hold the right and left portions of the bottoms of the groove portions of the corrugated sheet 6 being pressed by the second spurs 82 and the third spurs 83. As depicted in FIG. 6, the fourth ribs 74 may extend from respective positions upstream of the second spurs 82 to respective positions downstream of the third spurs 83 with respect to the conveying direction 19 (see FIG. 2). The fourth rib 74 may be disposed between each third rib 73 and each second spur 82 that may be adjacent to each other with respect to the right-left direction 9. With this configuration, the fourth ribs 74 may hold the right and left portions of the bottoms of the groove portions of the corrugated sheet 6. Upper edges of the fourth ribs 74 may be located lower than the upper edges of the second ribs 72 and the third ribs 73 to hold the groove portions of the corrugated sheet 6.

Figure 8B:
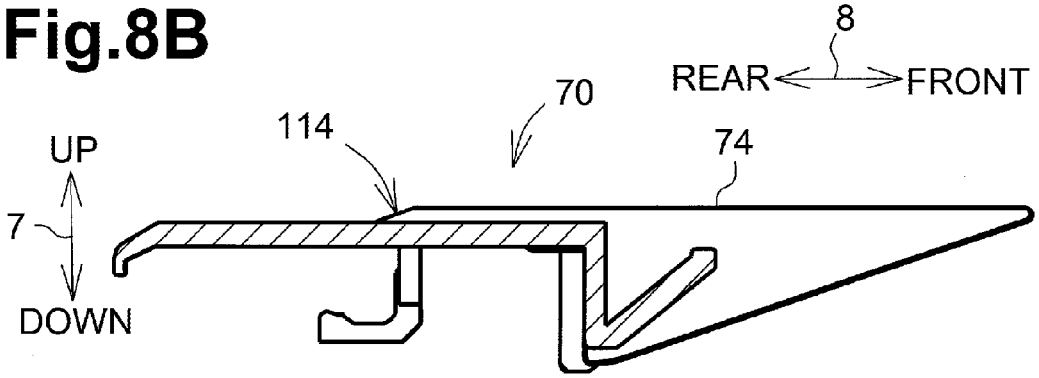
FIG. 8B is a vertical sectional view depicting the support member, taken along a line passing one of fourth ribs, in the first illustrative embodiment.

As depicted in FIG. 8B, each of the fourth ribs 74 may comprise a fourth guide surface 114 at an upstream end of each of the fourth ribs 74 in the conveying direction 19 (see FIG. 2). In each of the fourth ribs 74, the fourth guide surface 114 may extend obliquely upward from the upper surface of the base 71 to an upper edge of the fourth rib 74. The fourth guide surfaces 114 may come into contact with the leading edge of the sheet 6 to allow the sheet 6 to move to the upper edges of the fourth ribs 74. This configuration may reduce catching of the sheet 6 on the upstream ends of the fourth ribs 74 with respect to the conveying direction 19. While the sheet 6 is conveyed, the fourth ribs 74 may hold the right and left portions of the groove portions of the corrugated sheet 6, respectively.

An operation of the inkjet recording apparatus 10 is now described with reference to FIG. 2. First, the feed roller 43 may feed, one by one, one or more sheets 6 placed on the main tray 21 into the conveying path 31. Then, the conveyor roller pair 34 may convey the one or more fed sheets 6 successively. While the sheet 6 passes the contact portions 63 of the contact members 60, the first ribs 51 may hold the sheet 6 and the contact portions 63 of the contact members 60 may press an upper surface of the sheet 6 to form the sheet 6 into a corrugated shape. More specifically, the sheet 6 may be formed into the corrugated shape, in which the sheet 6 may have ridge portions that may be held by the first ribs 51 and groove portions that may be depressed by the contact portions 63.

The conveyor roller pair 34 may further convey the corrugated sheet 6 over the platen 50 without the sheet 6 curling. When a leading edge of the sheet 6 reaches under the nozzles 47 (see FIG. 3) of the recording head 46, the conveyor roller 35 may be allowed to stop rotating (e.g., the conveyor roller 35 may be stopped from rotating). After that, while the carriage 48 reciprocates along the right-left direction 9, the recording head 47 may eject ink droplets from the nozzles 47 onto the sheet 6 to perform a single line of printing. After performing the single line of printing, the conveyor roller 35 may be allowed to start rotating to convey the sheet 6 by a single line to start next single line of printing in a new line. The inkjet recording apparatus 10 may record an image on the sheet 6 by alternately performing a single line of printing and a line feed.

The conveyor roller pair 34 may convey the sheet 6 while the first ribs 61 of the platen 50 may hold the tops of the ridge portions of the corrugated sheet 6 and then the fifth ribs 75 of the support member 70 may hold the tops of the ridge portions of the corrugated sheet 6. After that, the tops of the ridge portions of the corrugated sheet 6 held by the fifth ribs 75 may reach the nip points of the discharge roller pair 37. The discharge roller pair 37 may nip the tops of the ridge portions of the corrugated sheet 6 and convey the sheet 6 further along the conveying direction 19.

The second ribs 72 may hold the tops of the ridge portions of the sheet 6 that has passed the nip points of the discharge roller pair 37. At this time, the first guide surfaces 111 and the fourth guide surfaces 114 may guide the groove portions of the sheet 6 to the lower ends of the second spurs 82 and the second spurs 82 may press the sheet 6 from above. Additionally, the trailing edge of the sheet 6 has not passed the contact portions 63 yet. Therefore, the forward part and the rearward part of the sheet 6 may be maintained in the corrugated shape. Thus, the sheet 6 may be reliably maintained in the corrugated shape.

After the leading edge of the sheet 6 passes the second spurs 82, the leading edge of the sheet 6 may reach the third ribs 73 and the fourth ribs 74. The discharge roller pair 37 may further convey the sheet 6 along the conveying direction 19 while the third ribs 73 hold the right and left portions of the ridge portions of the corrugated sheet 6, respectively, and the fourth ribs 74 hold the right and left portions of the groove portions of the corrugated sheet 6, respectively. The sheet 6 conveyed as described above may then reach the third spurs 83. The third spurs 83 may press the bottoms of the groove portions of the corrugated sheet 6, respectively. With this configuration, each second spur 82 and the corresponding third spur 3 may press the sheet 6 at two points spaced apart from each other in the conveying direction 19. Therefore, the sheet 6 may be conveyed without rotating about the second spurs 82 after passing the contact portions 63. None of the third spurs 83 may be disposed in the second zone. Each second spur 82 and the corresponding third spur 83 may press the sheet 6 at two points in the first zone.

When a sheet 6 having relatively higher stiffness is conveyed, the platen 50 may be pivotally moved from the first position depicted in FIG. 5A to the second position depicted in FIG. 5C against the urging force of the urging springs 555. Therefore, the sheet 6 may be conveyed without being formed into a corrugated shape as depicted in FIG. 5C. After performing image recording by the recording portion 45, the discharge roller pair 37 may nip and convey the sheet 6 further. While the sheet 6 passes under the second spurs 82 and the third spurs 83, the elastic shafts 201 of the second spurs 82 and the elastic shafts 301 of the third spurs 83 may be deformed by the sheet 6 such that the second spurs 82 and the third spurs 83 are upwardly moved. The discharge roller pair 37 may convey the sheet 6 to discharge the sheet 6 onto the sheet discharge tray 29 while maintaining the sheet 6 in the flat shape (e.g., without forming a corrugated shape/pattern) by which the sheet 6 may move the second spurs 82 and the third spurs 83 upward.

A case where a sheet 6 of smaller size is conveyed is now described. The length in the right-left direction 9 of the sheet 6 of smaller size may be less than a length between two third spurs 831 near the central portion (second zone). The sheets 6 of smaller sizes (e.g. postcard, and L-size sheet) are likely to have a higher stiffness than A4 plain paper. An A5 sheet may be placed with its long side oriented parallel to the front-rear direction 8. In this case, its paper fibers are directed parallel to the front-rear direction 8 and the A5 sheet, when conveyed, is unlikely to curl. When the sheet 6, which is a postcard, is conveyed, the platen 50 may pivot into the second position and the sheet 6 may not be formed into a corrugated shape. When the sheet 6, which is an A5 sheet, is conveyed, the sheet 6 may be formed into a corrugated shape. The discharge roller pair 37 may nip and convey further the sheet 6 having an image recorded thereon.

The discharge rollers 38 of the discharge roller pair 37 may be spaced from each other in the right-left direction 9, and so may be the first spurs 3 of the discharge roller pair 37. The sheet 6 of smaller size may be nipped by the discharge roller pair 37 at less nip points than a sheet of larger size. As depicted in FIGS. 11A and 11B, in the first illustrative embodiment, two discharge rollers 38 and two first spurs 39 of the discharge roller pair 37 may be disposed in the second zone. Thus, a conveying force applied by the discharge roller pair 37 to the sheet 6 of smaller size may be smaller than that applied to a sheet of larger size.

The sheet 6 of smaller size nipped and conveyed by the discharge roller pair 37 may contact and move up the second spurs 82 only. The sheet 6 may be conveyed further in a flat shape without contacting the third spurs 83 and discharged onto the discharge tray 29.

In a zone where the second spurs 82 and the third spurs 83 are positioned, only the second spurs 82 may apply their loads on the sheet 6 of smaller size. On the other hand, in that zone, the second spurs 82 and the third spurs 83 may apply their loads on a sheet 6 of larger size. Thus, downstream of the discharge roller pair 37 in the conveying direction 19, the sheet 6 of smaller size may receive less load than the sheet of larger size. Although the conveying force for the sheet 6 of smaller size may decrease, a pressing force, i.e., a conveyance resistance, to the sheet 6 of smaller size may be set less than to the sheet 6 of larger size. Consequently, the sheet conveying accuracy may be prevented from degrading.

In the first illustrative embodiment, the discharge roller pair 37 may nip the tops of the ridge portions of the corrugated sheet 6 and the second spurs 82 may press the bottoms of the groove portions of the corrugated sheet 6 from above. This configuration may maintain the sheet 6 in the corrugated shape. The second spurs 82 may be disposed downstream of the nip points of the discharge roller pair 37 in the conveying direction 19. Therefore, the second spurs 82 may press the bottoms of the groove portions of the corrugated sheet 6 after the discharge roller pair 37 nipped the tops of the ridge portions of the corrugated sheet 6. With this configuration, the depths of the groove portions may become stable (e.g., consistency in shape, depth, size, etc. may be maintained) when the second spurs 82 press the sheet 6. The second spurs 82 may be disposed downstream of the nip points of the discharge roller pair 37 in the conveying direction 19. Therefore, the discharge roller pair 37 may be disposed closer to the platen 50 as compared with a case where the second spurs 82 may be disposed upstream of the nip points of the discharge roller pair 37 with respect to the conveying direction 19. With this configuration, the sheet 6 that may tend to become flat due to the ink droplets adhered to the sheet 6 may be nipped by the discharge roller pair 37 before the sheet 6 becomes flat. Therefore, the change of the depths of the groove portions may be reduced/minimized and the depths of the groove portions may be stably maintained when the second spurs 82 press the sheet 6. Thus, a conveyance resistance to the sheet 6 may be reduced when the second spurs 82 press the sheet 6. As a result, in the first illustrative embodiment, the sheet 6 may be maintained in the corrugated shape and an occurrence of a paper jam or the degradation of the image-recording accuracy may be reduced.

In the first illustrative embodiment, the first guide surfaces 111 provided on the holder 103 may guide the bottoms of the groove portions of the corrugated sheet 6 to the lower ends of the second spurs 82 although the depth of one or more of the groove portions of the corrugated sheet 6 may become slightly shallower. As a result, the conveyance resistance to the sheet 6 may be further reduced.

In the first illustrative embodiment, the fourth ribs 74 may comprise the fourth guide surfaces 114, respectively, that may allow the leading edge of the sheet 6, which is moving obliquely downward by the first guide surfaces 111, to move to the lower ends of the second spurs 82. Therefore, an occurrence of a paper jam at the second spurs 82 may be reduced.

In the first illustrative embodiment, the second ribs 72 may hold the ridge portions of the corrugated sheet 6 when the second spurs 82 press the bottoms of the groove portions of the corrugated sheet 6. Therefore, the sheet 6 may be reliably maintained in the corrugated shape.

Additionally, the third spurs 83 may be disposed downstream of the second spurs 82 in the conveying direction 19 and the second spurs 82 and the third spurs 83 may press the sheet 6 at the two points spaced apart from each other in the conveying direction 19. This configuration may reduce the curling of the sheet 6 on the platen 50 after the trailing edge of the sheet 6 passes the contact portions 63.

In the first illustrative embodiment, the second spurs 82 may be rotatably disposed in pairs on respective elastic shafts 201 while each pair of spurs 82A may be spaced from each other in the right-left direction 9 by the spacer 202. The third spurs 83 may also be rotatably disposed in pairs on respective elastic shafts 301 while each pair of third spurs 83A may be spaced from each other in the right-left direction 9 by the spacer 302. Therefore, the force that may act on the sheet 6 may be scattered when the second spurs 82 and the third spurs 83 press the sheet 6. Accordingly, the conveyance resistance to the sheet 6 may be further reduced.

In the first illustrative embodiment, the third spurs 83 may be less in number than the second spurs 82 and no third spurs 83 may be positioned in the second zone through which the sheet 6 of smaller size passes. Thus, the load applied, as the conveyance resistance, to the sheet 6 of smaller size may relatively decrease, and the sheet conveying accuracy may be prevented from degrading. The third spurs 83 disposed in the first zone, which is defined at outer portions than the second zone in the right-left direction 9, may maintain a larger size sheet 6 having a relatively low stiffness in the corrugated shape and prevent the sheet 6 from curling.

In another embodiment, third spurs 83 may be disposed in the second zone through which the sheet 6 of smaller size passes as long as the pressing force or load (more specifically the pressing force or load per unit area) applied to the sheet 6 by the third spurs 83 positioned in the second zone is less than that applied by the second spurs 82 positioned in the second zone. For example, the spring constant of the elastic shaft 301 for supporting each third spur 83 disposed in the second zone may be less than that of the elastic shaft 201 for supporting each second spur 82. In this case, the spring constant of the elastic shaft 301 of each third spur 83 disposed in the first zone is preferably equal to that of the elastic shaft 201 of each second spur 82.

In another embodiment, as depicted in FIG. 11B, only second spurs 82 may be disposed downstream of the discharge roller pair 37 in the conveying direction 19. A plurality of second spurs 82 may be arranged in the right-left direction 9. The second spurs 821 positioned in the central portion (second zone) in the right-left direction 9 may be configured to apply less load (more specifically, less load per unit area) to the sheet 6 than the second spurs 822 positioned in the outer portions (first zone) in the right-left direction 9.

More specifically, the second spurs 821 may be positioned in the second zone through which the sheet 6 of smaller size (L-size sheet, postcard, and 2L-size sheet) may pass. The second spurs 822 may be positioned in the first zone which is defined at outer portions than the second zone in the right-left direction 9. The spring constant of an elastic shaft 821A of each second spur 821 may be set less than that of an elastic shaft 822A of each second spur 822.

In this case, when the discharge roller pair 37 nips and further conveys the sheet 6 of smaller size, the sheet 6 may contact the second spurs 821. The second spurs 821 may apply a relatively small load, i.e., a relatively small conveyance resistance, to the sheet 6. Thus, the sheet conveying accuracy may be prevented from degrading. Because the spring constant of the elastic shaft 822A of each second spur 822 may be greater than that of the elastic shaft 821A of each second spur 821, the second spurs 822 may maintain a larger size sheet 6 having a relatively low stiffness in the corrugated shape and prevent the sheet 6 from curling.

The above-described configuration may be modified as long as the pressing force (more specifically, the pressing force per unit area) applied by the second spurs 821 to the sheet 6 is less than that applied by the second spurs 822. For example, the contact position at which each second spur 821 contacts the sheet 6 may be set higher than the contact position at which each second spur 822 contacts the sheet 6.

Figure 9A:
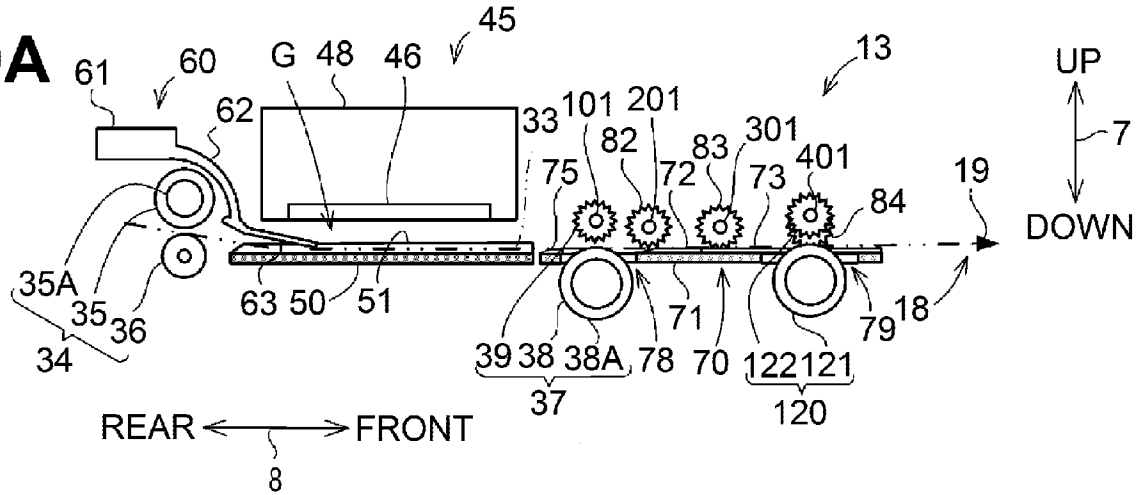
FIG. 9A is a partial schematic vertical sectional view depicting a main body in a first variation of the first illustrative embodiment according to one or more aspects of the disclosure.
Figure 12:
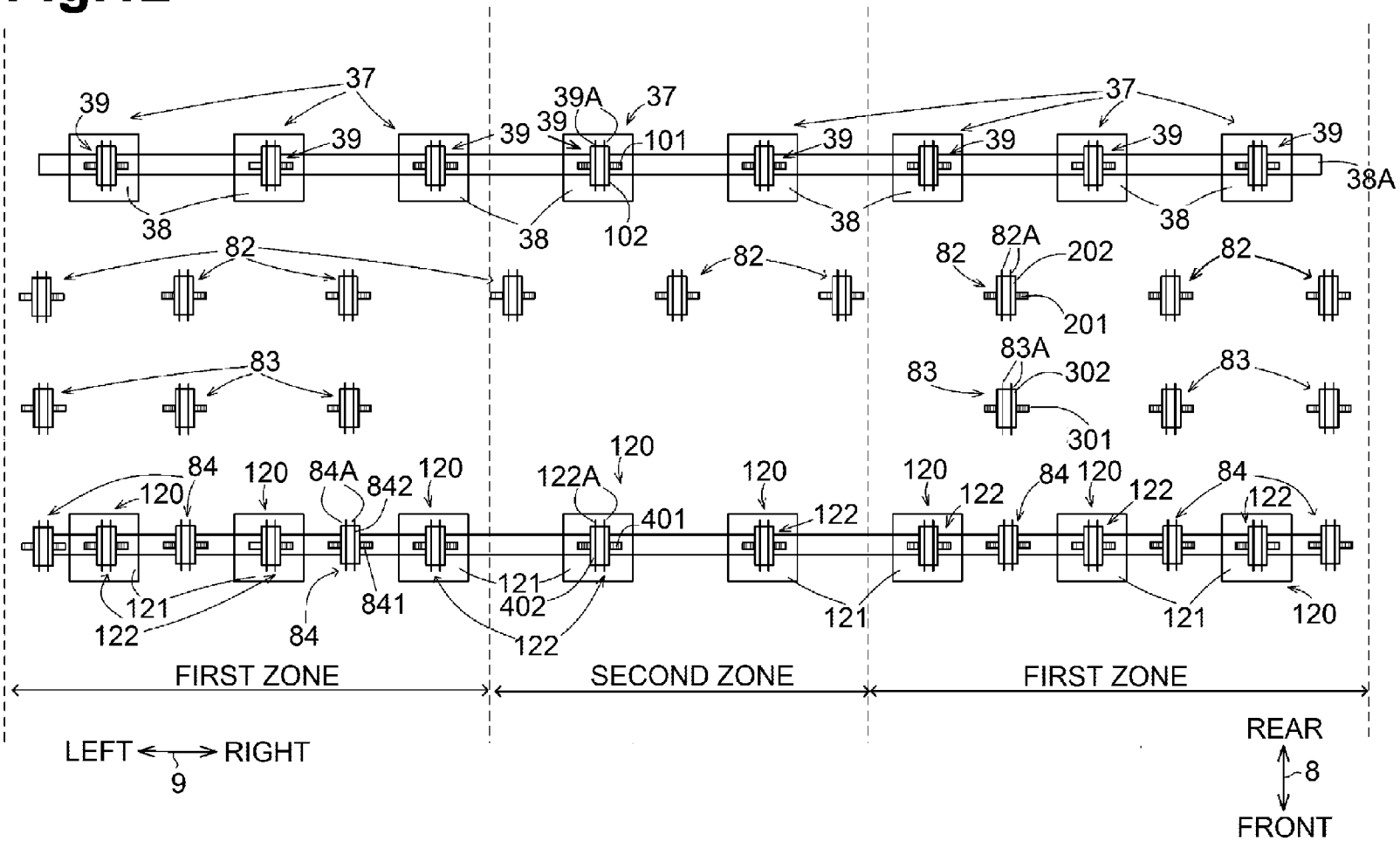
FIG. 12 is a schematic plan view depicting positions of a discharge roller pair, second spurs, third spurs, a roller pair, fourth spurs, and fifth spurs in the first variation of the first illustrative embodiment.

A first variation of the first illustrative embodiment is now described. As depicted in FIG. 9A, for example, a roller pair 120 (as an example of a third conveyor) may be further disposed downstream of the third spurs 83 with respect to the conveying direction 19 (see FIG. 2). As depicted in FIG. 12, the roller pair 120 may comprise rollers 121 having the same configuration as the discharge rollers 38, and fourth spurs 122 having the same configuration as the first spurs 39. The roller pair 120 may be disposed at the same position as the discharge roller pair 37 with respect to the up-down direction 7 and the right-left direction 9. Each of fourth spurs 122 may include a pair of spurs 122A fixed to a spacer 402 so as to be spaced from each other in the right-left direction 9. The pair of spurs 122A and the spacer 402 have a hole penetrating a center thereof. An elastic shaft 401, which may be a coil spring extending in the right-left direction 9, may be inserted into the hole so as to rotatably support the pair of spurs 122A and the spacer 402. The support member 70 may have openings 79. The rollers 121 may stick out (e.g., extend) from the upper surface of the support member 70 via the openings 79, respectively. Both end portions of each of the elastic shafts 401 of the fourth spurs 122 in the right-left direction 9 may be fixed to the holder 103.

Each of fifth spurs 84 (as an example of a second pressing portion) may be disposed between corresponding adjacent two fourth spurs 122 or next to a corresponding fourth spur 122. The fifth spurs 84 may be arranged in a row with the roller pair 120. The fifth spurs 84 may be disposed at the same positions with respect to the right-left direction 9 as the third spurs 83. In other words, the fifth spurs 84 may be disposed in the first zone at positions downstream of the third spurs 83 in the conveying direction 19, respectively. Each of fifth spurs 84 may include a pair of spurs 84A fixed to a spacer 842 so as to be spaced from each other in the right-left direction 9. The pair of spurs 84A and the spacer 842 has a hole penetrating a center thereof. An elastic shaft 841, which may be a coil spring extending in the right-left direction 9, may be inserted into the hole so as to rotatably support the pair of spurs 84A and the spacer 842. The other configuration of the inkjet recording apparatus 10 according to the first variation may be the same as the inkjet recording apparatus 10 according to the first illustrative embodiment described above.

The roller pair 120 may be configured to convey the sheet 6 to discharge the sheet 6 onto the sheet discharge tray 29 by nipping the tops of the ridge portions of the corrugated sheet 6. As described above, one or more aspects described herein may be adopted to the inkjet recording apparatus 10 that may further comprise the roller pair 120 disposed downstream of the third spurs 83 with respect to the conveying direction 19. The fifth spurs 84, in cooperation with the second spurs 82 and the third spurs 83, may press the bottoms of the groove portions of the corrugated sheet 6 from above to maintain the corrugation pattern of the sheet 6. Neither fifth spurs 84 nor third spurs 83 may be disposed in the second zone. Thus, the pressing force (load) applied, as the conveyance resistance, to the sheet 6 of smaller size may relatively decrease, and the sheet conveying accuracy may be prevented from degrading.

Figure 9B:
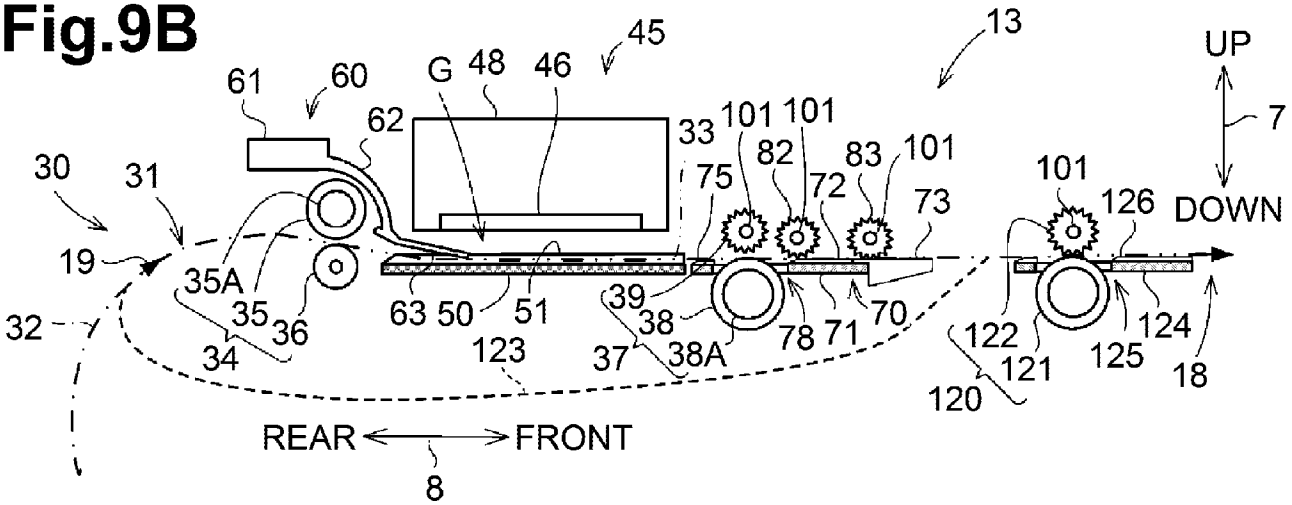
FIG. 9B is a partial schematic vertical sectional view of a main body in a second variation of the first illustrative embodiment according to one or more aspects of the disclosure.

A second variation of the first illustrative embodiment is now described. As depicted in FIG. 9B, for example, the inkjet recording apparatus 10 may have a double-sided printing function. The inkjet recording apparatus 10 may comprise the roller pair 120, a sheet reversing path 123, and a support member 124.

The support member 124 may be disposed downstream of the support member 70 in the conveying direction 19 (see FIG. 2). The support member 124 may have openings 125. The roller pair 120 may comprise the plurality of rollers 121. The rollers 121 of the roller pair 120 may stick out from an upper surface of the support member 124 via the openings 125, respectively. Sixth ribs 126 having the same configuration as the second ribs 72 may protrude from the upper surface of the support member 124. The sixth ribs 126 may be disposed at the same positions, in the up-down direction 7 and the right-left direction 9, as the second ribs 72. The sixth ribs 126 may also be configured to hold the tops of the ridge portions of the sheet 6, respectively.

The sheet reversing path 123 may extend from a position between the support member 70 and the support member 124 with respect to the conveying direction 19 to the curved section 32 by passing under the platen 50. The sheet reversing path 123 may be defined by one or more guide members (not depicted). The other configuration of the inkjet recording apparatus 10 according to the second variation may be the same as the inkjet recording apparatus 10 according to the first illustrative embodiment described above.

When the inkjet recording apparatus 10 performs the single-sided printing, the roller pair 120 may convey the sheet 6 on which an image has been recorded, along the conveying direction 19, to discharge the sheet 6 onto the sheet discharge tray 29. When the inkjet recording apparatus 10 performs double-sided printing, the roller pair 120 may rotate in the reverse direction after the trailing edge of the sheet 6 in which an image may be recorded on its one side passes the support member 70. Thus, the trailing edge of the sheet 6 with respect to the conveying direction 19 may enter the sheet reversing path 123. The inkjet recording apparatus 10 may convey the sheet 6 onto the platen 50 via the sheet reversing path 123 and the curved section 32 while the sheet 6 is turned upside down. Then, the inkjet recording apparatus 10 may record an image on the other side of the sheet 6 on the platen 50, and discharge the sheet 6 onto the sheet discharge tray 29 by the roller pair 120. As described above, the one or more aspects may be adopted to the inkjet recording apparatus 10 having the double-sided printing function.

Figure 8C:
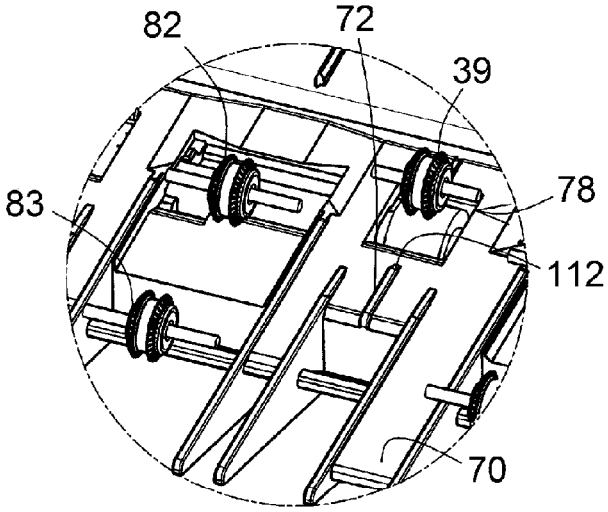
FIG. 8C is a partial perspective view of the support member in a third variation of the first illustrative embodiment according to one or more aspects of the disclosure.

A third variation of the first illustrative embodiment is now described. In the above-described first illustrative embodiment, as depicted in the enlarged view of FIG. 6, the upstream ends of the second ribs 72 with respect to the conveying direction 19 (see FIG. 2) may be disposed upstream of the lower ends of the second spurs 82 with respect to the conveying direction 19. In some arrangements, only the second ribs 72 might be needed to hold the ridge portions of the corrugated sheet 6 when the second spurs 82 press the groove portions of the corrugated sheet 6 from above. Therefore, in the third variation, for example, as depicted in FIG. 8C, the second ribs 72 may be disposed apart from the edges of the respective openings 78. More specifically, the second ribs 72 may be disposed such that the upstream ends of the second ribs 72 may extend along the conveying direction 19 from the same respective positions as the lower ends of the second spurs 82 with respect to the conveying direction 19. Accordingly, the second ribs 72 disposed as described above may hold the ridge portions of the corrugated sheet 6 when the second spurs 82 press the groove portions of the corrugated sheet 6, and the sheet 6 may be maintained in the corrugated shape.

Figure 10A:
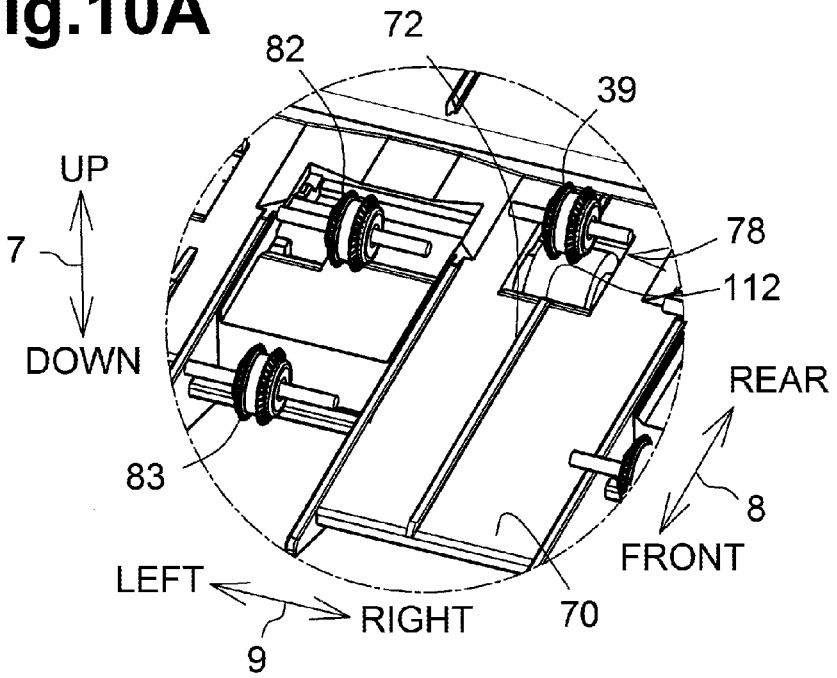
FIG. 10A is partial perspective view depicting a support member in a fourth variation of the first illustrative embodiment according to one or more aspects of the disclosure.

A fourth variation of the first illustrative embodiment is now described. In the above-described first illustrative embodiment, as depicted in FIG. 6, the second rib portions may comprise the second ribs 72 and the third ribs 73. Nevertheless, in the fourth variation, for example, as depicted in FIG. 10A, the second ribs 72 may extend to respective positions downstream of the third spurs 83 with respect to the conveying direction 19, instead of providing the third ribs 73. The second ribs 72 may hold the ridge portions of the sheet 6, respectively, when the second spurs 82 and the third spurs 83 press the groove portions of the sheet 6, respectively, from above. Therefore, the sheet 6 may be reliably maintained in the corrugated shape. All or one or more of the second ribs 72 may be configured like the second ribs 72 according to the fourth variation. In addition to the third ribs 73 (see FIG. 6), the second ribs 72 may extend to the respective positions downstream of the third spurs 83 with respect to the conveying direction 19.

Figure 10B:
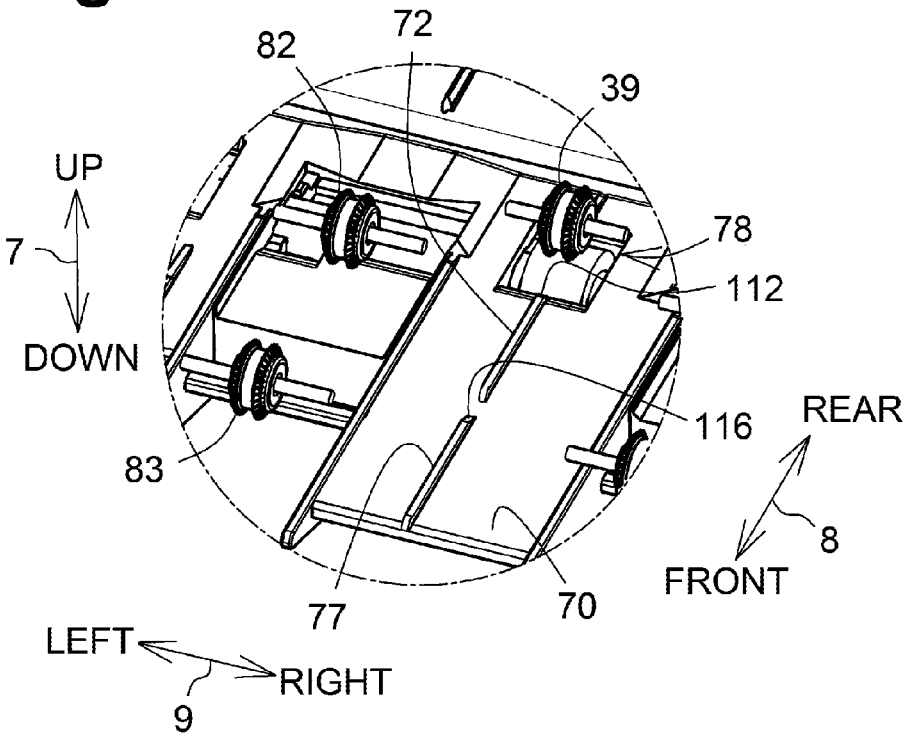
FIG. 10B is a partial perspective view depicting a support member in a fifth variation of the first illustrative embodiment according to one or more aspects of the disclosure.

A fifth variation of the first illustrative embodiment is now described. In the fourth variation, as depicted in FIG. 10A, the second ribs 72 may extend to the respective positions downstream of the third spurs 83 with respect to the conveying direction 19, instead of providing the third ribs 73. Nevertheless, in the fifth variation, for example, as depicted in FIG. 10B, seventh ribs 77 may be disposed instead of providing the third ribs 73. The seventh ribs 77 may be disposed as the same respective positions, in the right-left direction 9, as the second ribs 72. The seventh ribs 72 may extend to respective positions downstream of the second ribs 72 in the conveying direction 19. Upstream ends of the seventh ribs 77 may be disposed upstream of the third spurs 83 in the conveying direction 19. Downstream ends of the seventh ribs 77 may be disposed downstream of the third spurs 83 with respect to the conveying direction 19. Upper edges of the seventh ribs 77 may be located at the same level as the upper edges of the second ribs 72. Each of the seventh ribs 77 may comprise a seventh guide surface 117 at the upstream end of the seventh rib 77 with respect to the conveying direction 19. In each of the seventh ribs 77, the seventh guide surface 117 may extend obliquely upward from the upper surface of the support member 70 to the upper edge of the seventh rib 77. The seventh guide surfaces 117 may come into contact with the ridge portions of the corrugated sheet 6 to allow the ridge portions of the corrugated sheet 6 to move to the upper edges of the seventh ribs 77. This configuration may reduce catching of the sheet 6 on the upstream ends of the seventh ribs 77.

The seventh ribs 77 may hold the ridge portions of the sheet 6 when the third spurs 83 press the groove portions of the sheet 6. With this configuration, the sheet 6 may be further reliably maintained in the corrugated shape. One or more of the second ribs 72 according to the first illustrative embodiment may be configured like the second ribs 72 according to the fifth variation. In other embodiments, for example, one or more of the second ribs 72 may be configured like the second ribs 72 according to the fifth variation and one or more of the rest of the second ribs 72 may be configured like the second ribs 72 according to the fourth variation.

In the first illustrative embodiment, the pressing force (more specifically, the pressing force per unit area) applied to the sheet 6, which is conveyed downstream of the recording head 46 in the conveying direction 19, may set smaller in the second zone than in the first zoned zone. Similarly, the pressing force (more specifically, the pressing force per unit area) applied to the sheet 6, which is conveyed from an upstream point toward the recording head 46 in the conveying direction 19, may be set smaller in the second zone than in the first zone. In a sixth variation of the first illustrative embodiment, a platen 50 may be rotatably supported by the rotating shaft 38A of the discharge rollers 38 (see FIG. 2), as in the first illustrative embodiment, so as to pivot against the urging force of the urging springs 555 when a sheet 6 having a relatively higher stiffness, such as a cardboard sheet, is conveyed. In addition, the platen 50 may be configured such that the central portion thereof deforms or sags downward further than the outer portions thereof in the right-left direction 9.

Figure 14A:
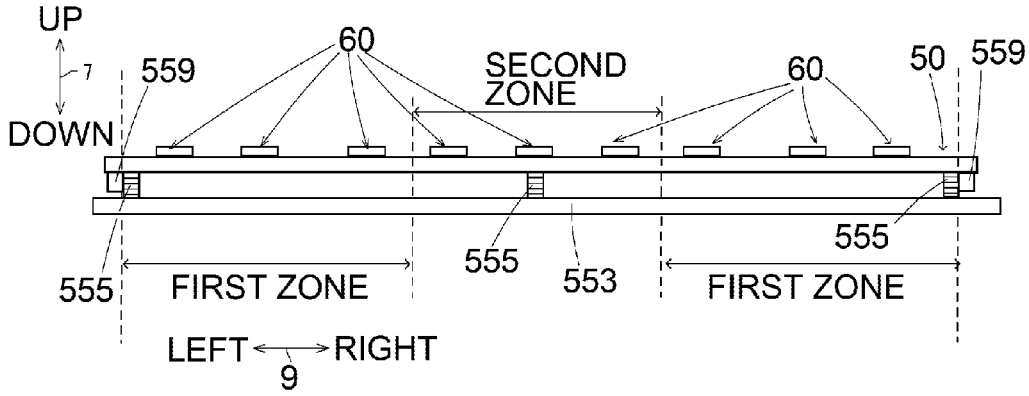
FIG. 14A is a schematic front view of the platen and its surroundings when no sheet is conveyed in the first illustrative embodiment.

As depicted in FIG. 14A, protrusions 559 may be formed in the outer portions, in the right-left direction 9, of the platen 50 so as to protrude downward from a lower surface of the platen 50. The protrusions 559 may be positioned outer than the first zone and near right and left ends of the platen 50. The platen 50 may be urged by the urging springs 555 in a direction away from the frame 553 of the printer unit 11. One of the urging springs 555 may be disposed at the center of the second zone through which sheets 6 of smaller sizes (e.g., L-size sheet, postcard, and 2L-size sheet) pass. Two of the urging springs 555 may be disposed in the first zone which is made up of the outer portions than the second zone in the right-left direction 9 and through which a sheet of maximum size (e.g., A4 sheet) passes. The urging forces of the three urging springs 555 may be set equal to each other.

Figure 14B:
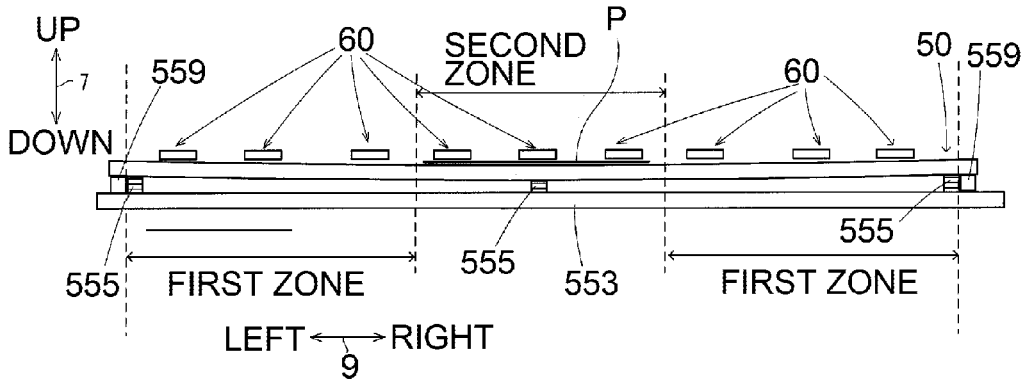
FIG. 14B is a schematic front view of the platen and its surroundings when a sheet of smaller size is conveyed in the first illustrative embodiment.
Figure 14C:
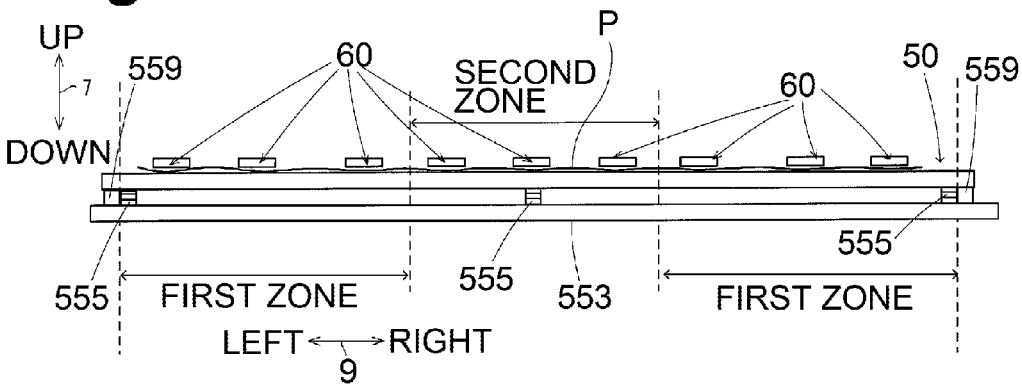
FIG. 14C is a schematic front view of the platen and its surroundings when a sheet having relatively lower stiffness is conveyed in the first illustrative embodiment.

As depicted in FIG. 14C, when a sheet 6 having a relatively low stiffness (e.g. A4 plain paper) is conveyed, the sheet 6 may be formed into a corrugated shape by the contact members 60, and the platen 50 may move down by the sheet thickness against the urging force of the urging springs 555. The entire sheet holding portion of the platen 50 in the right-left direction 9 may move down uniformly. At this time, the protrusions 559 may contact the frame 553. The sheet 6 may extend over the first zone and the second zone. The pressing force of the contact members 60 may be applied through the sheet 6 to the platen 50. Once the protrusions 559 contact the frame 553, the platen 50 may not be allowed to move down further. Thus, the sheet 6 may be conveyed in a space between the platen 50 and the contact members 60 which may be elastically deformed. The discharge rollers 38 and the first spurs 39 of the discharge roller pair 37, which are arranged in the right-left direction 9, may convey the sheet 6 against the pressing force of the contact members 60.

As depicted in FIG. 14B, when a smaller size sheet having a relatively higher stiffness (e.g. glossy paper) is conveyed through the second zone, the platen 50 may move down against the urging force of the urging springs 555. When the platen 50 moves down by the pressing force of the contact members 60 till the protrusions 559 contact the frame 553, the platen 50 may deform such that the central portion thereof sags downward further than the outer portions thereof in the right-left direction 9. The pressing force applied from above by the contact members 60 to the smaller size sheet 6 may be less when the platen 50 is deformable than when the platen 50 is not deformable. Thus, even when the smaller size sheet 6 is conveyed with a relatively small conveying force of the discharge roller pair 37, the load applied, as the conveyance resistance, to the sheet 6 may relatively decrease. Consequently, the sheet conveying accuracy may be prevented from degrading.

By providing the protrusions 50 to the platen 50, the pressing force (more specifically, the pressing force per unit area) applied to a sheet 6 conveyed, on the upstream side of the recording head 46, through the second zone may be set smaller than the pressing force (more specifically, the pressing force per unit area) applied to a sheet 6 conveyed, on the upstream side of the recording head 46, through the first zone. At least two of the protrusions 559 may be positioned within the first zone in the right-left direction 9, at such positions that allow the central portion of the platen 50 to sag enough for sheet conveyance.

Other variations of the first illustrative embodiment are now described. In the above-described first illustrative embodiment, the third spurs 83 may be disposed in pairs on respective elastic shafts 101 to press the respective groove portions of the corrugated sheet 6. Nevertheless, in other variations, for example, one each of the third spurs 82 may be disposed on each of the elastic shafts 101. The third spurs 83 may be configured to press the respective groove portions that are being pressed by the corresponding second spurs 82. Accordingly, it may be unnecessary for the third spurs 83 to press the sheet 6 with the same force as that applied by the second spurs 82. In some cases, it may be unnecessary to scatter or distribute the sheet pressing force of the third spurs 83. In this case, one each of the third spurs 83 may be disposed on each of the elastic shafts 101.

According to one or more aspects, when the force of the second spurs 82 that press the sheet 6 is smaller, one each of the second spurs 82 may also be disposed on each of the elastic shafts 101.

In the above-described first illustrative embodiment, the third spurs 83 may be provided in the inkjet recording apparatus 10. Nevertheless, in other embodiments or variations, for example, the inkjet recording apparatus 10 might not comprise the third spurs 83. Instead, the second spurs 82 may maintain the sheet 6 in the corrugated shape appropriately by pressing the groove portions of the corrugated sheet 6 without providing/using the third spurs 83.

In the above-described first illustrative embodiment, the contact portions 60 and the first ribs 51 may be provided in the inkjet recording apparatus 10 to form the corrugated shape in the sheet 6. Nevertheless, in other embodiments or variations, for example, other mechanisms may be provided upstream of the nozzles 47 in the conveying direction 19 to form the corrugated shape in the sheet 6.

In the above-described first illustrative embodiment, the support member 70 may be provided in the inkjet recording apparatus 10. Nevertheless, in other embodiments or variations, for example, the inkjet recording apparatus might not comprise the support member 70. In this case, the second spurs 82 may be disposed downstream of the nip points of the discharge roller pair 37 in the conveying direction 19 and close to the nip points of the discharge roller pair 37. With this configuration, the discharge roller pair 37 and the second spurs 82 may maintain the sheet 6 in the corrugated shape appropriately even though the second ribs 72 of the support member 70 do not hold the ridge portions of the corrugated sheet 6.

In the above-described first illustrative embodiment, the holder 103 may comprise the first guide surfaces 111. However, in other embodiments or variations, for example, the holder 103 might not comprise the first guide surfaces 111. In this case, the discharge roller pair 37 may be disposed as close to the nozzles 47 of the recording head 46, in the conveying direction 19, as possible. With this configuration, the discharge roller pair 37 may nip the sheet 6 therebetween immediately after the sheet 6 becomes flat due to the ink droplets adhered to the sheet 6. Therefore, it may become unnecessary to guide the groove portions of the corrugated sheet 6 to the second spurs 82.

In the above-described first illustrative embodiment, the first to seventh guide surfaces 111-117 may be provided. Nevertheless, in other embodiments or variations, for example, the first to seventh guide surfaces 111-117 might not be provided. The sheet 6 may be maintained in the corrugated shape appropriately and the risk of a paper jam may be reduced without the provision of the first to seventh guide surfaces 111-117.

In the above-described first illustrative embodiment, the first to seventh guide surfaces 111-117 may be the inclined surfaces (flat surfaces). Nevertheless, in other embodiments or variations, for example, the first to seventh guide surfaces 111-117 may be spherical surfaces or curved surfaces.

The features as set forth herein are intended to be illustrative, not limiting. Various changes may be made without departing from the spirit and scope of the inventions as defined in the following claims.

What is claimed is:

1. An inkjet recording apparatus, comprising:

a first conveyor configured to selectively nip and convey a first sheet and a second sheet in a conveying direction, the second sheet having a shorter length in a first direction than the first sheet, the first direction being perpendicular to the conveying direction and a vertical direction;

a recording head comprising nozzles configured to eject ink droplets onto a sheet conveyed by the first conveyor;

a corrugate mechanism disposed upstream of the nozzles in the conveying direction and configured to form the sheet into a corrugated shape having alternating ridge portions and groove portions arranged in the first direction;

a plurality of second conveyors disposed downstream of the nozzles in the conveying direction and spaced from each other in the first direction, each of the plurality of second conveyors being spaced, in the conveying direction, from a corresponding first portion of the corrugate mechanism, the corresponding first portion configured to form one of the ridge portions in the sheet, the plurality of second conveyors being configured to nip the sheet at nip points and convey the sheet; and a plurality of first pressing portions disposed downstream of the nozzles in the conveying direction and spaced from each other in the first direction, each of the plurality of first pressing portions being spaced, in the conveying direction, from a corresponding second portion of the corrugate mechanism, the corresponding second portion configured to form one of the groove portions in the sheet, the plurality of first pressing portions being configured to contact, at lower ends thererof, an upper surface of the sheet, and the lower ends being positioned lower than the nip points of the plurality of second conveyors, wherein the inkjet recording apparatus defines a first zone configured to receive passage of the first sheet but not passage of the second sheet, and a second zone configured to receive passage of the first sheet and the second sheet, and wherein the plurality of first pressing portions comprise first pressing portions positioned in the first zone and first pressing portions positioned in the second zone, and a pressing force per unit area configured to be applied to the sheet by the first pressing portions positioned in the second zone is less than a pressing force per unit area configured to be applied to the sheet by the first pressing portions positioned in the first zone.

2. The inkjet recording apparatus according to claim 1, wherein the first pressing portions positioned in the first zone comprise:

upstream pressing portions arranged in the first direction; and downstream pressing portions disposed downstream of the upstream pressing portions in the conveying direction and arranged in the first direction, and wherein each of the first pressing portions positioned in the second zone are arranged in a row with the upstream pressing portions positioned in the first zone.

3. The inkjet recording apparatus according to claim 1, wherein the first pressing portions positioned in the first zone and the first pressing portions positioned in the second zone are arranged in a single row.

4. The inkjet recording apparatus according to claim 1, wherein the plurality of first pressing portions are disposed downstream of the nip points of the plurality of second conveyors in the conveying direction.

5. The inkjet recording apparatus according to claim 1, further comprising:

a discharge port through which the inkjet recording apparatus is configured to discharge the sheet;

a plurality of third conveyors disposed between the plurality of first pressing portions and the discharge port in the conveying direction, and spaced from each other in the first direction, each of the plurality of third conveyors being spaced from a corresponding second conveyor in the conveying direction, the plurality of third conveyors being configured to nip the sheet at nip points and convey the sheet; and a plurality of second pressing portions arranged in a row with the plurality of third conveyors in the first direction and each spaced from a corresponding first pressing portion in the conveying direction, the plurality of second pressing portions being configured to contact, at lower ends thereof, the upper surface of the sheet, and the lower ends being positioned lower than the nip points of the plurality of third conveyors.

6. The inkjet recording apparatus according to claim 5, wherein the plurality of third conveyors are positioned in the first zone and the second zone, and the plurality of second pressing portions are positioned in the first zone but not positioned in the second zone.

7. The inkjet recording apparatus according to claim 1, further comprising a platen which includes a plurality of ribs disposed downstream of the first conveyor in the conveying direction and extending in the conveying direction, the plurality of ribs being spaced from each other in the first direction and configured to support, at upper edges thereof, the sheet, wherein the corrugate mechanism comprises:

the plurality of ribs of the platen; and a plurality of third pressing portions spaced from each other in the first direction and each interposed between a corresponding pair of the plurality of ribs, the plurality of third pressing portions being configured to contact, at lower ends thereof, the upper surface of the sheet held by the plurality of ribs, and the lower ends being lower than upper edges of the plurality of ribs.

8. The inkjet recording apparatus according to claim 7, wherein the platen is configured to move up and down relative to the plurality of third pressing portions between a first position and a second position, wherein the inkjet recording apparatus further comprises a plurality of urging members configured to urge the platen upward toward the first position, and wherein the second zone is defined between a first part and a second part of the first zone in the first direction, and the plurality of urging members comprise an urging member positioned at a center of the second zone in the first direction, an urging member positioned in the first part, and an urging member positioned in the second part symmetrically to the urging member positioned in the first part relative to the urging member positioned at the center.

9. The inkjet recording apparatus according to claim 8, further comprising a support member configured to support the platen when the platen moves down into the second position, wherein each of the urging members is sandwiched between the platen and the support member, and wherein the platen comprises a first protrusion and a second protrusion which protrude toward the support member and are positioned in the first part and the second part of the first zone respectively, and a portion of the platen between the first protrusion and the second protrusion is deformable toward the support member when the support member receives the first protrusion and the second protrusion of the platen in the second position.

10. The inkjet recording apparatus according to claim 1, wherein the plurality of first pressing portions comprise a plurality of spurs rotatably supported about an axis extending in the first direction.

11. The inkjet recording apparatus according to claim 1, wherein each of the plurality of first pressing portions comprises a pair of spurs spaced from each other in the first direction, and a spacer disposed between the pair of spurs.

12. The inkjet recording apparatus according to claim 10, wherein each of the plurality of first pressing portions comprises a resilient shaft for rotatably supporting a corresponding one of the plurality of spurs.

13. An inkjet recording apparatus, comprising:

a first conveyor configured to selectively nip and convey a first sheet and a second sheet in a conveying direction, the second sheet having a shorter length in a first direction than the first sheet, the first direction being perpendicular to the conveying direction and a vertical direction;

a recording head comprising nozzles configured to eject ink droplets onto a sheet conveyed by the first conveyor;

a corrugate mechanism disposed upstream of the nozzles in the conveying direction and configured to form the sheet into a corrugated shape having alternating ridge portions and groove portions arranged in the first direction;

a plurality of second conveyors disposed downstream of the nozzles in the conveying direction and spaced from each other in the first direction, each of the plurality of second conveyors being spaced, in the conveying direction, from a corresponding first portion of the corrugate mechanism, the corresponding first portion configured to form one of the ridge portions in the sheet, the plurality of second conveyors being configured to nip the sheet at nip points and convey the sheet; and a plurality of first pressing portions disposed downstream of the nozzles in the conveying direction and spaced from each other in the first direction, each of the plurality of first pressing portions being spaced, in the conveying direction, from a corresponding second portion of the corrugate mechanism, the corresponding second portion configured to form one of the groove portions in the sheet respectively, the plurality of first pressing portions being configured to contact, at lower ends thererof, an upper surface of the sheet, and the lower ends being positioned lower than the nip points of the plurality of second conveyors, wherein the inkjet recording apparatus defines, in the first direction, a first zone configured to receive passage of the first sheet but not passage of the second sheet, and a second zone configured to receive passage of the first sheet and the second sheet, and wherein the first pressing portions comprise upstream pressing portions positioned in the first zone and the second zone and arranged in the first direction, and downstream pressing portions positioned in the first zone but not in the second zone and arranged in the first direction at positions downstream of the upstream pressing portions in the conveying direction.

14. An inkjet recording apparatus, comprising:

a first conveyor configured to selectively nip and convey a first sheet and a second sheet in a conveying direction, the second sheet having a shorter length in a first direction than the first sheet, the first direction being perpendicular to the conveying direction and a vertical direction;

a recording head comprising nozzles configured to eject ink droplets onto a sheet conveyed by the first conveyor;

a platen configured to move up and down between a first position and a second position and comprising a plurality of ribs disposed downstream of the first conveyor in the conveying direction and extending in the conveying direction, the plurality of ribs being spaced from each other in the first direction and configured to support, at upper edges thereof, the sheet conveyed by the first conveyor;

a plurality of pressing portions spaced from each other in the first direction and each interposed between a corresponding pair of the plurality of ribs, the plurality of pressing portions being configured to contact, at lower ends thereof, the upper surface of the sheet held by the plurality of ribs;

a support member configured to support the platen when the platen moves down into the second position; and a plurality of urging members, each of the urging members being sandwiched between the platen and the support member and configured to urge the platen upward toward the first position, wherein the inkjet recording apparatus define a first zone configured to receive passage of the first sheet but not passage of the second sheet, and a second zone configured to receive passage of the first sheet and the second sheet, and wherein the platen further comprises a plurality of protrusions protruding toward the support member, and a portion of the platen positioned in the second zone is deformable toward the support member when the support member receives the plurality of protrusions of the platen in the second position.

15. The inkjet recording apparatus according to claim 14, wherein the second zone is defined between a first part and a second part of the first zone in the first direction, and the plurality of protrusions are positioned in the first part and the second part of the first zone but not positioned in the second zone.

* * * * *